US009931867B1

(12) United States Patent
Yap et al.

(10) Patent No.: US 9,931,867 B1
(45) Date of Patent: Apr. 3, 2018

(54) METHOD AND SYSTEM OF DETERMINING A WIDTH OF A PRINTER RIBBON

(71) Applicant: Datamax-O'Neil Corporation, Orlando, FL (US)

(72) Inventors: Yaw Horng Yap, Singapore (SG); Teck Siong Soh, Singapore (SG); Boon Kheng Lim, Singapore (SG); Aravindkumar Harinarayanan, Singapore (SG)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

(21) Appl. No.: 15/274,573

(22) Filed: Sep. 23, 2016

(51) Int. Cl.
*B41J 15/02* (2006.01)
*B41J 11/00* (2006.01)

(52) U.S. Cl.
CPC ..... *B41J 11/007* (2013.01); *B41J 15/02* (2013.01)

(58) Field of Classification Search
CPC . B41J 11/007; B41J 15/02; B41J 15/04; B41J 15/16; B41J 33/56; B41J 33/58; B41J 33/08; B41J 17/32; B41J 17/34; B41J 11/0025; B41J 11/003
See application file for complete search history.

(56) References Cited

U.S. PATENT DOCUMENTS 3,859,649 A * 1/1975 Slack ..... B65H 23/0204 200/DIG. 11
5,333,959 A * 8/1994 Yamaguchi ..... B41J 32/00 400/208

(Continued)

FOREIGN PATENT DOCUMENTS

JP 63027339 A * 2/1988
WO 2013163789 A1 11/2013
WO 2013173985 A1 11/2013
WO 2014019130 A1 2/2014
WO 2014110495 A1 7/2014

OTHER PUBLICATIONS

U.S. Appl. No. 13/367,978, filed Feb. 7, 2012, (Feng et al.); now abandoned.

(Continued)

*Primary Examiner* — Julian Huffman
*Assistant Examiner* — Michael Konczal
(74) *Attorney, Agent, or Firm* — Additon, Higgins & Pendleton, P.A.

(57) ABSTRACT

A printer ribbon supply spindle assembly is provided. The ribbon spindle has multiple segments contiguous to each other. The spindle assembly includes a commutator disposed circumferentially on the first segment of the ribbon spindle and two carbon brushes connected to a voltage source and disposed generally in electrical contact with and on either side of the commutator. The voltage source, the carbon brushes, and the commutator complete an electrical circuit. C-shaped conductive springs are disposed over each of the multiple segments. The c-shaped conductive springs compress when covered by a printer ribbon and become in electrical contact with the commutator and adjacent compressed c-shaped springs, forming additional parallel circuits. An electronic element is disposed at the center of the c-shaped conductive springs. Measuring a change in the circuit due the additional parallel circuits with the electronic element indicates the printer ribbon width.

25 Claims, 8 Drawing Sheets

(56) References Cited

U.S. PATENT DOCUMENTS 5,598,639 A * 2/1997 Webb ..... G01B 7/14 33/657
6,832,725 B2 12/2004 Gardiner et al.
7,128,266 B2 10/2006 Zhu et al.
7,159,783 B2 1/2007 Walczyk et al.
7,413,127 B2 8/2008 Ehrhart et al.
7,726,575 B2 6/2010 Wang et al.
8,294,969 B2 10/2012 Plesko
8,317,105 B2 11/2012 Kotlarsky et al.
8,322,622 B2 12/2012 Liu
8,366,005 B2 2/2013 Kotlarsky et al.
8,371,507 B2 2/2013 Haggerty et al.
8,376,233 B2 2/2013 Van Horn et al.
8,381,979 B2 2/2013 Franz
8,390,909 B2 3/2013 Plesko
8,408,464 B2 4/2013 Zhu et al.
8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.

(56) References Cited

U.S. PATENT DOCUMENTS

| | | | |
|---|---|---|---|
| 8,939,374 | B2 | 1/2015 | Jovanovski et al. |
| 8,942,480 | B2 | 1/2015 | Ellis |
| 8,944,313 | B2 | 2/2015 | Williams et al. |
| 8,944,327 | B2 | 2/2015 | Meier et al. |
| 8,944,332 | B2 | 2/2015 | Harding et al. |
| 8,950,678 | B2 | 2/2015 | Germaine et al. |
| D723,560 | S | 3/2015 | Zhou et al. |
| 8,967,468 | B2 | 3/2015 | Gomez et al. |
| 8,971,346 | B2 | 3/2015 | Sevier |
| 8,976,030 | B2 | 3/2015 | Cunningham et al. |
| 8,976,368 | B2 | 3/2015 | Akel et al. |
| 8,978,981 | B2 | 3/2015 | Guan |
| 8,978,983 | B2 | 3/2015 | Bremer et al. |
| 8,978,984 | B2 | 3/2015 | Hennick et al. |
| 8,985,456 | B2 | 3/2015 | Zhu et al. |
| 8,985,457 | B2 | 3/2015 | Soule et al. |
| 8,985,459 | B2 | 3/2015 | Kearney et al. |
| 8,985,461 | B2 | 3/2015 | Gelay et al. |
| 8,988,578 | B2 | 3/2015 | Showering |
| 8,988,590 | B2 | 3/2015 | Gillet et al. |
| 8,991,704 | B2 | 3/2015 | Hopper et al. |
| 8,996,194 | B2 | 3/2015 | Davis et al. |
| 8,996,384 | B2 | 3/2015 | Funyak et al. |
| 8,998,091 | B2 | 4/2015 | Edmonds et al. |
| 9,002,641 | B2 | 4/2015 | Showering |
| 9,007,368 | B2 | 4/2015 | Laffargue et al. |
| 9,010,641 | B2 | 4/2015 | Qu et al. |
| 9,015,513 | B2 | 4/2015 | Murawski et al. |
| 9,016,576 | B2 | 4/2015 | Brady et al. |
| D730,357 | S | 5/2015 | Fitch et al. |
| 9,022,288 | B2 | 5/2015 | Nahill et al. |
| 9,030,964 | B2 | 5/2015 | Essinger et al. |
| 9,033,240 | B2 | 5/2015 | Smith et al. |
| 9,033,242 | B2 | 5/2015 | Gillet et al. |
| 9,036,054 | B2 | 5/2015 | Koziol et al. |
| 9,037,344 | B2 | 5/2015 | Chamberlin |
| 9,038,911 | B2 | 5/2015 | Xian et al. |
| 9,038,915 | B2 | 5/2015 | Smith |
| D730,901 | S | 6/2015 | Oberpriller et al. |
| D730,902 | S | 6/2015 | Fitch et al. |
| D733,112 | S | 6/2015 | Chaney et al. |
| 9,047,098 | B2 | 6/2015 | Barten |
| 9,047,359 | B2 | 6/2015 | Caballero et al. |
| 9,047,420 | B2 | 6/2015 | Caballero |
| 9,047,525 | B2 | 6/2015 | Barber |
| 9,047,531 | B2 | 6/2015 | Showering et al. |
| 9,049,640 | B2 | 6/2015 | Wang et al. |
| 9,053,055 | B2 | 6/2015 | Caballero |
| 9,053,378 | B1 | 6/2015 | Hou et al. |
| 9,053,380 | B2 | 6/2015 | Xian et al. |
| 9,057,641 | B2 | 6/2015 | Amundsen et al. |
| 9,058,526 | B2 | 6/2015 | Powilleit |
| 9,064,165 | B2 | 6/2015 | Havens et al. |
| 9,064,167 | B2 | 6/2015 | Xian et al. |
| 9,064,168 | B2 | 6/2015 | Todeschini et al. |
| 9,064,254 | B2 | 6/2015 | Todeschini et al. |
| 9,066,032 | B2 | 6/2015 | Wang |
| 9,070,032 | B2 | 6/2015 | Corcoran |
| D734,339 | S | 7/2015 | Zhou et al. |
| D734,751 | S | 7/2015 | Oberpriller et al. |
| 9,082,023 | B2 | 7/2015 | Feng et al. |
| 9,224,022 | B2 | 12/2015 | Ackley et al. |
| 9,224,027 | B2 | 12/2015 | Van Horn et al. |
| D747,321 | S | 1/2016 | London et al. |
| 9,230,140 | B1 | 1/2016 | Ackley |
| 9,250,712 | B1 | 2/2016 | Todeschini |
| 9,258,033 | B2 | 2/2016 | Showering |
| 9,262,633 | B1 | 2/2016 | Todeschini et al. |
| 9,310,609 | B2 | 4/2016 | Rueblinger et al. |
| D757,009 | S | 5/2016 | Oberpriller et al. |
| 9,342,724 | B2 | 5/2016 | McCloskey |
| 9,375,945 | B1 | 6/2016 | Bowles |
| D760,719 | S | 7/2016 | Zhou et al. |
| 9,390,596 | B1 | 7/2016 | Todeschini |
| D762,604 | S | 8/2016 | Fitch et al. |
| D762,647 | S | 8/2016 | Fitch et al. |
| 9,412,242 | B2 | 8/2016 | Van Horn et al. |
| D766,244 | S | 9/2016 | Zhou et al. |
| 9,443,123 | B2 | 9/2016 | Hejl |
| 9,443,222 | B2 | 9/2016 | Singel et al. |
| 9,478,113 | B2 | 10/2016 | Xie et al. |
| 2007/0063048 | A1 | 3/2007 | Havens et al. |
| 2009/0134221 | A1 | 5/2009 | Zhu et al. |
| 2010/0177076 | A1 | 7/2010 | Essinger et al. |
| 2010/0177080 | A1 | 7/2010 | Essinger et al. |
| 2010/0177707 | A1 | 7/2010 | Essinger et al. |
| 2010/0177749 | A1 | 7/2010 | Essinger et al. |
| 2011/0169999 | A1 | 7/2011 | Grunow et al. |
| 2011/0202554 | A1 | 8/2011 | Powilleit et al. |
| 2012/0111946 | A1 | 5/2012 | Golant |
| 2012/0168512 | A1 | 7/2012 | Kotlarsky et al. |
| 2012/0193423 | A1 | 8/2012 | Samek |
| 2012/0203647 | A1 | 8/2012 | Smith |
| 2012/0223141 | A1 | 9/2012 | Good et al. |
| 2013/0043312 | A1 | 2/2013 | Van Horn |
| 2013/0075168 | A1 | 3/2013 | Amundsen et al. |
| 2013/0175341 | A1 | 7/2013 | Kearney et al. |
| 2013/0175343 | A1 | 7/2013 | Good |
| 2013/0257744 | A1 | 10/2013 | Daghigh et al. |
| 2013/0257759 | A1 | 10/2013 | Daghigh |
| 2013/0270346 | A1 | 10/2013 | Xian et al. |
| 2013/0287258 | A1 | 10/2013 | Kearney |
| 2013/0292475 | A1 | 11/2013 | Kotlarsky et al. |
| 2013/0292477 | A1 | 11/2013 | Hennick et al. |
| 2013/0293539 | A1 | 11/2013 | Hunt et al. |
| 2013/0293540 | A1 | 11/2013 | Laffargue et al. |
| 2013/0306728 | A1 | 11/2013 | Thuries et al. |
| 2013/0306731 | A1 | 11/2013 | Pedraro |
| 2013/0307964 | A1 | 11/2013 | Bremer et al. |
| 2013/0308625 | A1 | 11/2013 | Park et al. |
| 2013/0313324 | A1 | 11/2013 | Koziol et al. |
| 2013/0313325 | A1 | 11/2013 | Wilz et al. |
| 2013/0342717 | A1 | 12/2013 | Havens et al. |
| 2014/0001267 | A1 | 1/2014 | Giordano et al. |
| 2014/0002828 | A1 | 1/2014 | Laffargue et al. |
| 2014/0008439 | A1 | 1/2014 | Wang |
| 2014/0025584 | A1 | 1/2014 | Liu et al. |
| 2014/0034734 | A1 | 2/2014 | Sauerwein |
| 2014/0036848 | A1 | 2/2014 | Pease et al. |
| 2014/0039693 | A1 | 2/2014 | Havens et al. |
| 2014/0042814 | A1 | 2/2014 | Kather et al. |
| 2014/0049120 | A1 | 2/2014 | Kohtz et al. |
| 2014/0049635 | A1 | 2/2014 | Laffargue et al. |
| 2014/0061306 | A1 | 3/2014 | Wu et al. |
| 2014/0063289 | A1 | 3/2014 | Hussey et al. |
| 2014/0066136 | A1 | 3/2014 | Sauerwein et al. |
| 2014/0067692 | A1 | 3/2014 | Ye et al. |
| 2014/0070005 | A1 | 3/2014 | Nahill et al. |
| 2014/0071840 | A1 | 3/2014 | Venancio |
| 2014/0074746 | A1 | 3/2014 | Wang |
| 2014/0076974 | A1 | 3/2014 | Havens et al. |
| 2014/0078341 | A1 | 3/2014 | Havens et al. |
| 2014/0078342 | A1 | 3/2014 | Li et al. |
| 2014/0078345 | A1 | 3/2014 | Showering |
| 2014/0098792 | A1 | 4/2014 | Wang et al. |
| 2014/0100774 | A1 | 4/2014 | Showering |
| 2014/0100813 | A1 | 4/2014 | Showering |
| 2014/0103115 | A1 | 4/2014 | Meier et al. |
| 2014/0104413 | A1 | 4/2014 | McCloskey et al. |
| 2014/0104414 | A1 | 4/2014 | McCloskey et al. |
| 2014/0104416 | A1 | 4/2014 | Giordano et al. |
| 2014/0104451 | A1 | 4/2014 | Todeschini et al. |
| 2014/0106594 | A1 | 4/2014 | Skvoretz |
| 2014/0106725 | A1 | 4/2014 | Sauerwein |
| 2014/0108010 | A1 | 4/2014 | Maltseff et al. |
| 2014/0108402 | A1 | 4/2014 | Gomez et al. |
| 2014/0108682 | A1 | 4/2014 | Caballero |
| 2014/0110485 | A1 | 4/2014 | Toa et al. |
| 2014/0114530 | A1 | 4/2014 | Fitch et al. |
| 2014/0124577 | A1 | 5/2014 | Wang et al. |
| 2014/0124579 | A1 | 5/2014 | Ding |
| 2014/0125842 | A1 | 5/2014 | Winegar |
| 2014/0125853 | A1 | 5/2014 | Wang |
| 2014/0125999 | A1 | 5/2014 | Longacre et al. |

(56) References Cited

U.S. PATENT DOCUMENTS

| | | | |
|---|---|---|---|
| 2014/0129378 | A1 | 5/2014 | Richardson |
| 2014/0131438 | A1 | 5/2014 | Kearney |
| 2014/0131441 | A1 | 5/2014 | Nahill et al. |
| 2014/0131443 | A1 | 5/2014 | Smith |
| 2014/0131444 | A1 | 5/2014 | Wang |
| 2014/0131445 | A1 | 5/2014 | Ding et al. |
| 2014/0131448 | A1 | 5/2014 | Xian et al. |
| 2014/0133379 | A1 | 5/2014 | Wang et al. |
| 2014/0136208 | A1 | 5/2014 | Maltseff et al. |
| 2014/0140585 | A1 | 5/2014 | Wang |
| 2014/0151453 | A1 | 6/2014 | Meier et al. |
| 2014/0152882 | A1 | 6/2014 | Samek et al. |
| 2014/0158770 | A1 | 6/2014 | Sevier et al. |
| 2014/0159869 | A1 | 6/2014 | Zumsteg et al. |
| 2014/0166755 | A1 | 6/2014 | Liu et al. |
| 2014/0166757 | A1 | 6/2014 | Smith |
| 2014/0166759 | A1 | 6/2014 | Liu et al. |
| 2014/0168787 | A1 | 6/2014 | Wang et al. |
| 2014/0175165 | A1 | 6/2014 | Havens et al. |
| 2014/0175172 | A1 | 6/2014 | Jovanovski et al. |
| 2014/0191644 | A1 | 7/2014 | Chaney |
| 2014/0191913 | A1 | 7/2014 | Ge et al. |
| 2014/0197238 | A1 | 7/2014 | Liu et al. |
| 2014/0197239 | A1 | 7/2014 | Havens et al. |
| 2014/0197304 | A1 | 7/2014 | Feng et al. |
| 2014/0203087 | A1 | 7/2014 | Smith et al. |
| 2014/0204268 | A1 | 7/2014 | Grunow et al. |
| 2014/0214631 | A1 | 7/2014 | Hansen |
| 2014/0217166 | A1 | 8/2014 | Berthiaume et al. |
| 2014/0217180 | A1 | 8/2014 | Liu |
| 2014/0231500 | A1 | 8/2014 | Ehrhart et al. |
| 2014/0232930 | A1 | 8/2014 | Anderson |
| 2014/0247315 | A1 | 9/2014 | Marty et al. |
| 2014/0263493 | A1 | 9/2014 | Amurgis et al. |
| 2014/0263645 | A1 | 9/2014 | Smith et al. |
| 2014/0270196 | A1 | 9/2014 | Braho et al. |
| 2014/0270229 | A1 | 9/2014 | Braho |
| 2014/0278387 | A1 | 9/2014 | DiGregorio |
| 2014/0282210 | A1 | 9/2014 | Bianconi |
| 2014/0284384 | A1 | 9/2014 | Lu et al. |
| 2014/0288933 | A1 | 9/2014 | Braho et al. |
| 2014/0297058 | A1 | 10/2014 | Barker et al. |
| 2014/0299665 | A1 | 10/2014 | Barber et al. |
| 2014/0312121 | A1 | 10/2014 | Lu et al. |
| 2014/0319220 | A1 | 10/2014 | Coyle |
| 2014/0319221 | A1 | 10/2014 | Oberpriller et al. |
| 2014/0326787 | A1 | 11/2014 | Barten |
| 2014/0332590 | A1 | 11/2014 | Wang et al. |
| 2014/0344943 | A1 | 11/2014 | Todeschini et al. |
| 2014/0346233 | A1 | 11/2014 | Liu et al. |
| 2014/0351317 | A1 | 11/2014 | Smith et al. |
| 2014/0353373 | A1 | 12/2014 | Van Horn et al. |
| 2014/0361073 | A1 | 12/2014 | Qu et al. |
| 2014/0361082 | A1 | 12/2014 | Xian et al. |
| 2014/0362184 | A1 | 12/2014 | Jovanovski et al. |
| 2014/0363015 | A1 | 12/2014 | Braho |
| 2014/0369511 | A1 | 12/2014 | Sheerin et al. |
| 2014/0374483 | A1 | 12/2014 | Lu |
| 2014/0374485 | A1 | 12/2014 | Xian et al. |
| 2015/0001301 | A1 | 1/2015 | Ouyang |
| 2015/0001304 | A1 | 1/2015 | Todeschini |
| 2015/0003673 | A1 | 1/2015 | Fletcher |
| 2015/0009338 | A1 | 1/2015 | Laffargue et al. |
| 2015/0009610 | A1 | 1/2015 | London et al. |
| 2015/0014416 | A1 | 1/2015 | Kotlarsky et al. |
| 2015/0021397 | A1 | 1/2015 | Rueblinger et al. |
| 2015/0028102 | A1 | 1/2015 | Ren et al. |
| 2015/0028103 | A1 | 1/2015 | Jiang |
| 2015/0028104 | A1 | 1/2015 | Ma et al. |
| 2015/0029002 | A1 | 1/2015 | Yeakley et al. |
| 2015/0032709 | A1 | 1/2015 | Maloy et al. |
| 2015/0039309 | A1 | 2/2015 | Braho et al. |
| 2015/0040378 | A1 | 2/2015 | Saber et al. |
| 2015/0048168 | A1 | 2/2015 | Fritz et al. |
| 2015/0049347 | A1 | 2/2015 | Laffargue et al. |
| 2015/0051992 | A1 | 2/2015 | Smith |
| 2015/0053766 | A1 | 2/2015 | Havens et al. |
| 2015/0053768 | A1 | 2/2015 | Wang et al. |
| 2015/0053769 | A1 | 2/2015 | Thuries et al. |
| 2015/0062366 | A1 | 3/2015 | Liu et al. |
| 2015/0063215 | A1 | 3/2015 | Wang |
| 2015/0063676 | A1 | 3/2015 | Lloyd et al. |
| 2015/0069130 | A1 | 3/2015 | Gannon |
| 2015/0071819 | A1 | 3/2015 | Todeschini |
| 2015/0083800 | A1 | 3/2015 | Li et al. |
| 2015/0086114 | A1 | 3/2015 | Todeschini |
| 2015/0088522 | A1 | 3/2015 | Hendrickson et al. |
| 2015/0096872 | A1 | 4/2015 | Woodburn |
| 2015/0099557 | A1 | 4/2015 | Pettinelli et al. |
| 2015/0100196 | A1 | 4/2015 | Hollifield |
| 2015/0102109 | A1 | 4/2015 | Huck |
| 2015/0115035 | A1 | 4/2015 | Meier et al. |
| 2015/0127791 | A1 | 5/2015 | Kosecki et al. |
| 2015/0128116 | A1 | 5/2015 | Chen et al. |
| 2015/0129659 | A1 | 5/2015 | Feng et al. |
| 2015/0133047 | A1 | 5/2015 | Smith et al. |
| 2015/0134470 | A1 | 5/2015 | Hejl et al. |
| 2015/0136851 | A1 | 5/2015 | Harding et al. |
| 2015/0136854 | A1 | 5/2015 | Lu et al. |
| 2015/0142492 | A1 | 5/2015 | Kumar |
| 2015/0144692 | A1 | 5/2015 | Hejl |
| 2015/0144698 | A1 | 5/2015 | Teng et al. |
| 2015/0144701 | A1 | 5/2015 | Xian et al. |
| 2015/0149946 | A1 | 5/2015 | Benos et al. |
| 2015/0161429 | A1 | 6/2015 | Xian |
| 2015/0169925 | A1 | 6/2015 | Chang et al. |
| 2015/0169929 | A1 | 6/2015 | Williams et al. |
| 2015/0186703 | A1 | 7/2015 | Chen et al. |
| 2015/0193644 | A1 | 7/2015 | Kearney et al. |
| 2015/0193645 | A1 | 7/2015 | Colavito et al. |
| 2015/0199957 | A1 | 7/2015 | Funyak et al. |
| 2015/0204671 | A1 | 7/2015 | Showering |
| 2015/0210199 | A1 | 7/2015 | Payne |
| 2015/0220753 | A1 | 8/2015 | Zhu et al. |
| 2015/0254485 | A1 | 9/2015 | Feng et al. |
| 2015/0327012 | A1 | 11/2015 | Bian et al. |
| 2016/0014251 | A1 | 1/2016 | Hejl |
| 2016/0040982 | A1 | 2/2016 | Li et al. |
| 2016/0042241 | A1 | 2/2016 | Todeschini |
| 2016/0057230 | A1 | 2/2016 | Todeschini et al. |
| 2016/0109219 | A1 | 4/2016 | Ackley et al. |
| 2016/0109220 | A1 | 4/2016 | Laffargue |
| 2016/0109224 | A1 | 4/2016 | Thuries et al. |
| 2016/0112631 | A1 | 4/2016 | Ackley et al. |
| 2016/0112643 | A1 | 4/2016 | Laffargue et al. |
| 2016/0124516 | A1 | 5/2016 | Schoon et al. |
| 2016/0125217 | A1 | 5/2016 | Todeschini |
| 2016/0125342 | A1 | 5/2016 | Miller et al. |
| 2016/0133253 | A1 | 5/2016 | Braho et al. |
| 2016/0171720 | A1 | 6/2016 | Todeschini |
| 2016/0178479 | A1 | 6/2016 | Goldsmith |
| 2016/0180678 | A1 | 6/2016 | Ackley et al. |
| 2016/0189087 | A1 | 6/2016 | Morton et al. |
| 2016/0125873 | A1 | 7/2016 | Braho et al. |
| 2016/0227912 | A1 | 8/2016 | Oberpriller et al. |
| 2016/0232891 | A1 | 8/2016 | Pecorari |
| 2016/0292477 | A1 | 10/2016 | Bidwell |
| 2016/0294779 | A1 | 10/2016 | Yeakley et al. |
| 2016/0306769 | A1 | 10/2016 | Kohtz et al. |
| 2016/0314276 | A1 | 10/2016 | Sewell et al. |
| 2016/0314294 | A1 | 10/2016 | Kubler et al. |

OTHER PUBLICATIONS

U.S. Appl. No. 14/277,337 for Multipurpose Optical Reader, filed May 14, 2014 (Jovanovski et al.); 59 pages; now abandoned.

U.S. Appl. No. 14/446,391 for Multifunction Point of Sale Apparatus With Optical Signature Capture filed Jul. 30, 2014 (Good et al.); 37 pages; now abandoned.

U.S. Appl. No. 29/516,892 for Table Computer filed Feb. 6, 2015 (Bidwell et al.); 13 pages.

U.S. Appl. No. 29/523,098 for Handle for a Tablet Computer filed Apr. 7, 2015 (Bidwell et al.); 17 pages.

(56) References Cited

OTHER PUBLICATIONS

U.S. Appl. No. 29/528,890 for Mobile Computer Housing filed Jun. 2, 2015 (Fitch et al.); 61 pages.
U.S. Appl. No. 29/526,918 for Charging Base filed May 14, 2015 (Fitch et al.); 10 pages.
U.S. Appl. No. 14/715,916 for Evaluating Image Values filed May 19, 2015 (Ackley); 60 pages.
U.S. Appl. No. 29/525,068 for Tablet Computer With Removable Scanning Device filed Apr. 27, 2015 (Schulte et al.); 19 pages.
U.S. Appl. No. 29/468,118 for an Electronic Device Case, filed Sep. 26, 2013 (Oberpriller et al.); 44 pages.
U.S. Appl. No. 29/530,600 for Cyclone filed Jun. 18, 2015 (Vargo et al); 16 pages.
U.S. Appl. No. 14/707,123 for Application Independent DEX/UCS Interface filed May 8, 2015 (Pape); 47 pages.
U.S. Appl. No. 14/283,282 for Terminal Having Illumination and Focus Control filed May 21, 2014 (Liu et al.); 31 pages; now abandoned.
U.S. Appl. No. 14/705,407 for Method and System to Protect Software-Based Network-Connected Devices From Advanced Persistent Threat filed May 6, 2015 (Hussey et al.); 42 pages.
U.S. Appl. No. 14/704,050 for Intermediate Linear Positioning filed May 5, 2015 (Charpentier et al.); 60 pages.
U.S. Appl. No. 14/705,012 for Hands-Free Human Machine Interface Responsive to a Driver of a Vehicle filed May 6, 2015 (Fitch et al.); 44 pages.
U.S. Appl. No. 14/715,672 for Augumented Reality Enabled Hazard Display filed May 19, 2015 (Venkatesha et al.); 35 pages.
U.S. Appl. No. 14/735,717 for Indicia-Reading Systems Having an Interface With a User's Nervous System filed Jun. 10, 2015 (Todeschini); 39 pages.
U.S. Appl. No. 14/702,110 for System and Method for Regulating Barcode Data Injection Into a Running Application on a Smart Device filed May 1, 2015 (Todeschini et al.); 38 pages.
U.S. Appl. No. 14/747,197 for Optical Pattern Projector filed Jun. 23, 2015 (Thuries et al.); 33 pages.
U.S. Appl. No. 14/702,979 for Tracking Battery Conditions filed May 4, 2015 (Young et al.); 70 pages.
U.S. Appl. No. 29/529,441 for Indicia Reading Device filed Jun. 8, 2015 (Zhou et al.); 14 pages.
U.S. Appl. No. 14/747,490 for Dual-Projector Three-Dimensional Scanner filed Jun. 23, 2015 (Jovanovski et al.); 40 pages.
U.S. Appl. No. 14/740,320 for Tactile Switch for a Mobile Electronic Device filed Jun. 16, 2015 (Bamdringa); 38 pages.
U.S. Appl. No. 14/740,373 for Calibrating a Volume Dimensioner filed Jun. 16, 2015 (Ackley et al.); 63 pages.

* cited by examiner

METHOD AND SYSTEM OF DETERMINING A WIDTH OF A PRINTER RIBBON

FIELD OF THE INVENTION

The present invention relates to printer ribbon supply spindles and particularly to sensing the ribbon width of a ribbon loaded on such a printer ribbon supply spindle.

BACKGROUND

Generally speaking certain printers employing ribbons on spindles allow various printer ribbon widths to be loaded on the spindle for different printing media. Printer ribbons of different widths have different torque requirements. The torque requirements affect print quality, print registration, ribbon slippage, and ribbon wrinkling. Thus it is important for the printer torque value to be set appropriate to the ribbon width loaded on the ribbon spindle.

While systems exist to automatically sense the size of print media loaded into a printer by having an electrical feedback connected to the media size adjustment mechanism, nothing such exists for printer ribbon rolls. Further such systems would not be tell the printer or user anything about the proper torque values to be used for any given printing job.

Therefore, a need exists for an automatic system which can sense a printer ribbon width on a printer ribbon spindle assembly and feedback this information to an onboard processor which can implement torque requirements.

SUMMARY

Accordingly, in one aspect, the present invention embraces a printer ribbon supply spindle assembly. Generally, the printer ribbon supply spindle assembly has a base and multiple segments. The first of the multiple segments being contiguous to the base, and each subsequent segment of the multiple segments being contiguous to the previous segment of the multiple segments.

In an exemplary embodiment, the printer ribbon supply spindle is comprised of a commutator disposed circumferentially on the first segment of the ribbon spindle, and at least two carbon brushes connected to a voltage source. The carbon brushes are disposed generally on either side of the commutator and in electrical contact with the commutator. Thus, the voltage source, the carbon brushes, and the commutator form a closed electrical circuit. The printer ribbon supply spindle further is comprised of a c-shaped conductive spring disposed on each of the multiple segments. The c-shaped conductive springs each have two ends and a center portion. The c-shaped conductive springs are in an uncompressed state when there is no printer ribbon on the ribbon spindle positioned over the c-shaped conductive spring on each of the segments. The c-shaped conductive springs compress when a printer ribbon is positioned on the ribbon spindle over the c-shaped conductive spring on each of the segments. In particular, the c-shaped conductive spring over the second of the multiple segments has a length such that when the c-shaped conductive spring is in the compressed state, the two ends of the c-shaped conductive spring make electrical contact with the commutator, completing a first additional electrical circuit in parallel with the closed electrical circuit. Further, the c-shaped conductive springs over subsequent segments of the multiple segments have lengths such that when the c-shaped conductive springs are in the compressed state, the two ends of the c-shaped conductive springs make electrical contact with the c-shaped conductive spring of the previous segment, thus completing additional electrical circuits in parallel with the closed electrical circuit. The printer ribbon supply spindle assembly is further comprised of a basic electronic element disposed proximate to each of the center portions of the c-shaped conductive springs and in electrical contact with the center portion of the c-shaped conductive springs.

In another exemplary embodiment of the printer ribbon supply spindle assembly, the basic electronic element is a resistor.

In another exemplary embodiment of the printer ribbon supply spindle assembly, the basic electronic element is a dielectric material.

In another exemplary embodiment of the printer ribbon supply spindle assembly, the center portion of the c-shaped conductive springs is comprised of two conductive plates and a dielectric material. The conductive plates are disposed on either side of the dielectric material. The conductive plates come into contact with the dielectric material based upon the c-shaped conductive springs being compressed.

In yet another exemplary embodiment, the printer ribbon supply spindle assembly further comprises, a meter in the closed electrical circuit. The meter is sensitive to the electrical properties of the basic electronic element, such that the reading on the meter indicates how many additional parallel circuits are completed.

In another exemplary embodiment of the printer ribbon supply spindle assembly, the closed electrical circuit comprised of the voltage source, the carbon brushes, and the commutator also includes the basic electronic element.

In another exemplary embodiment of the printer ribbon supply spindle assembly, the c-shaped conductive springs are metallic.

In another aspect, the present invention embraces a printer spindle assembly.

In an exemplary embodiment, the printer spindle assembly is comprised of multiple segments. The first segment of the multiple segments is adjacent to a base. Each subsequent segment of the multiple segments is adjacent to the previous segment of the multiple segments. The printer spindle assembly is also comprised of a commutator, at least two brushes, and a c-shaped conductive spring disposed on each of the multiple segments. The commutator is disposed circumferentially on the first segment of the spindle. The brushes are connected to a voltage source and are disposed generally on either side of the commutator. The brushes are in electrical contact with the commutator. The voltage source, the brushes, and the commutator form a closed electrical circuit. The c-shaped conductive spring has two ends and a center portion. Further, the c-shaped conductive springs are in an uncompressed state in the absence of a printer ribbon over the one or more c-shaped conductive springs. The c-shaped conductive springs are in a compressed state in the presence of a printer ribbon positioned over the one or more c-shaped conductive springs.

In another exemplary embodiment of the printer spindle assembly, the c-shaped conductive spring on each segment of the multiple segments has a length such that when the c-shaped conductive spring is in the compressed state, the two ends of the c-shaped conductive spring make electrical contact with the commutator or the c-shaped conductive spring of a previous segment, thus completing an additional electrical circuit in parallel with the closed electrical circuit.

In another exemplary embodiment of the printer spindle assembly, a basic electronic element is disposed proximate to the center portions of each of the c-shaped conductive springs and in electrical contact with the center portion of the c-shaped conductive springs.

In another exemplary embodiment of the printer spindle assembly, the basic electronic element is a resistor.

In another exemplary embodiment of the printer spindle assembly, the basic electronic element is a dielectric material.

In another exemplary embodiment of the printer spindle assembly, the center portion of the c-shaped conductive springs is comprised of two conductive plates and a dielectric material. The conductive plates are disposed on either side of the dielectric material. The conductive plates come in contact with the dielectric material when upon the c-shaped conductive springs are compressed.

In yet another exemplary embodiment, the printer spindle assembly further comprises a meter. The meter is connected to the closed electrical circuit, such that the reading on the meter indicates how many additional parallel circuits are completed.

In another exemplary embodiment of the printer spindle assembly, each additional circuit includes the basic electronic element.

In another exemplary embodiment of the printer spindle assembly, the c-shaped conductive springs are metallic.

In yet another exemplary embodiment, the printer spindle assembly further comprises a processor communicatively linked to the meter. The processor is configured to determine a width of a ribbon roll loaded on the printer spindle based upon a reading on the meter and to implement printer functions based upon the reading on the meter.

In another exemplary embodiment of the printer spindle, the processor is further configured to send information on the width of the ribbon roll loaded on the spindle to a display.

In another exemplary embodiment of the printer spindle assembly, the printer functions include torque requirements of the printer.

In another exemplary embodiment of the printer spindle, the basic electronic element is a resistor. The printer spindle assembly further comprises a meter. The meter is connected to the closed electrical circuit. The meter reads the resistance of the completed circuits.

In another exemplary embodiment of the printer spindle assembly, the basic electronic element is a dielectric material. The printer spindle assembly further comprises a meter. The meter is connected to the closed electrical circuit. The meter reads capacitance changes in the circuits completed.

In another aspect, the present invention embraces a system for determining the width of a ribbon roll mounted on a printer ribbon spindle.

In an exemplary embodiment, the system is comprised of: a printer ribbon supply spindle having a base and multiple segments. The first of the multiple segments are contiguous to the base, and each subsequent segment of the multiple segments is contiguous to the previous segment of the multiple segments. The system further comprises a commutator disposed circumferentially on the first segment of the ribbon spindle and at least two carbon brushes connected to a voltage source. The carbon brushes are disposed generally on either side of the commutator and are in electrical contact with the commutator. Thus, the voltage source, the carbon brushes, and the commutator form a closed electrical circuit. The system further comprises a c-shaped conductive spring disposed on each of the multiple segments. Each of the c-shaped conductive springs has two ends and a center portion. The c-shaped conductive springs are in an uncompressed state when no printer ribbon is loaded on the ribbon spindle over the c-shaped conductive spring on each of the segments. On the other hand, the c-shaped conductive springs are in a compressed state when a printer ribbon is loaded on the spindle and positioned over the c-shaped conductive spring on each of the segments. In particular, the c-shaped conductive spring over the second of the multiple segments has a length such that when the c-shaped conductive spring is in the compressed state, the two ends of the c-shaped conductive spring make electrical contact with the commutator, thus completing a first additional electrical circuit in parallel with the closed electrical circuit. In a similar way, the c-shaped conductive springs over subsequent segments of the multiple segments have lengths such that when the c-shaped conductive springs are in the compressed state, the two ends of the c-shaped conductive springs make electrical contact with the c-shaped conductive spring of the previous segment, thus completing additional electrical circuits in parallel with the closed electrical circuit. The system further is comprised of a basic electronic element disposed proximate to each of the center portions of the c-shaped conductive springs and in electrical contact with the center portion of the c-shaped conductive springs. Further, a meter is provided in the closed electrical circuit. The meter is sensitive to the electrical properties of the basic electronic element, such that the reading on the meter indicates how many additional parallel circuits are completed. The system further comprises a processor communicatively linked to the meter. The processor is configured to determine the width of the ribbon roll loaded on the printer ribbon supply spindle based upon the reading on the meter. Further, the processor is configured to implement printer functions based upon the reading on the meter.

In another exemplary embodiment of the system, the basic electronic element is a resistor, and the meter reads the resistance of the completed circuits.

In another exemplary embodiment of the system, the basic electronic element is a dielectric material, and the meter reads capacitance changes in the circuits completed.

In another exemplary embodiment of the system, the processor is further configured to send information on the width of the ribbon roll loaded on the printer ribbon supply spindle to a display on the printer.

In another exemplary embodiment of the system, the printer functions include torque requirements of the printer.

In another aspect, the invention embraces a method of determining a width of a printer ribbon loaded on a ribbon spindle having multiple segments.

In an exemplary embodiment, the method comprises the steps of: providing, on a base segment of the ribbon spindle, a commutator electrically in contact with two carbon brushes disposed on either side of the commutator; forming a closed electrical circuit by connecting the two carbon brushes to a voltage source; providing compressible conductive elements on each of the multiple segment, and being in electrical contact with each other and with the closed electrical circuit when compressed, thus forming additional completed parallel electrical circuits with the closed electrical circuit when the conductive elements are compressed; loading the printer ribbon on the ribbon spindle; compressing at least one of the compressible conductive elements under the printer ribbon; measuring the change in electrical properties of the closed electrical circuit due to the additional completed parallel electrical circuits; determining, based upon the measuring step, how many compressible conductive elements are compressed under the loaded printer ribbon; and determining the printer ribbon width from the determination of the number of compressible conductive elements being compressed under the loaded printer ribbon.

In another exemplary embodiment, the method further comprises the step of: providing the compressible conductive elements with a basic electronic element. The change in electrical properties measured in the measuring are due to the basic electronic elements included in the completed additional parallel circuits formed by the compressing step.

In another exemplary embodiment of the method, the basic electronic element is a resistor, and the measuring step measures a change in resistance.

In another exemplary embodiment of the method, the basic electronic element is a dielectric material, and the measuring step measures a change in capacitance.

In another exemplary embodiment, the method further comprises the step of displaying the ribbon width determined in the second determining step on a printer display.

In yet another exemplary embodiment, the method further comprises the step of implementing printer functions based upon the ribbon width determined in the second determining step.

In another exemplary embodiment of the method, the implementing step is accomplished with a processor. The printer functions implemented by the processor include torque requirements.

In another exemplary embodiment of the method, the measuring step is accomplished with an electrical meter sensitive to the electrical properties of the basic electronic element.

In another aspect, the present invention embraces a method of determining a width of a printer media loaded on a media spindle having multiple segments.

In an exemplary embodiment, the method includes the steps of: (i) loading a printer media on a spindle; (ii) providing, on a base segment of a spindle, a commutator electrically in contact with two brushes disposed on either side of the commutator; (iii) forming a closed electrical circuit by connecting the two brushes to a voltage source; (iv) providing compressible conductive elements on each of the multiple segments on the spindle; (v) compressing one or more of the compressible conductive elements under the printer media, the compressible conductive elements when compressed being in electrical contact with each other and with the closed electrical circuit, thus forming additional completed parallel electrical circuits with the closed electrical circuit; (vi) measuring a change in electrical properties of the closed electrical circuit due to the additional completed parallel electrical circuits; (vii) determining, based upon the measured change, how many compressible conductive elements are compressed under the loaded printer media; and (viii) determining a printer media width from the determination of the number of compressible conductive elements being compressed under the loaded printer media.

In another exemplary embodiment of the method, the media is selected from a ribbon, a label, a receipt, and a thermal transfer ribbon.

In another exemplary embodiment, the method further comprises the step (ix) of providing the compressible conductive elements with a basic electronic element.

In another exemplary embodiment of the method, the change in electrical properties measured in the measuring step are due to the basic electronic elements included in the completed additional parallel circuits formed by the compressing step.

In another exemplary embodiment of the method, the basic electronic element is a resistor.

In another exemplary embodiment of the method, the measuring step measures a change in resistance.

In another exemplary embodiment of the method, the basic electronic element is a dielectric material. The measuring step measures a change in capacitance.

In yet another exemplary embodiment, the method further comprises the step (x) of displaying the media width determined in the second determining step on a display.

In another exemplary embodiment, the method further comprises the step (xi) of implementing printer functions based upon the media width determined in the second determining step.

In another exemplary embodiment of the method, the printer functions include torque requirements.

In another exemplary embodiment of the method, the measuring step is accomplished with an electrical meter sensitive to the electrical properties of the basic electronic element.

The foregoing illustrative summary, as well as other exemplary objectives and/or advantages of the invention, and the manner in which the same are accomplished, are further explained within the following detailed description and its accompanying drawings.

DETAILED DESCRIPTION

The present invention embraces a printer ribbon supply spindle assembly. The printer ribbon supply spindle assembly generally has a base and multiple segments. The first of the multiple segments is contiguous to the base, and each subsequent segment of the multiple segments is contiguous to the previous segment of the multiple segments.

Figure 1:
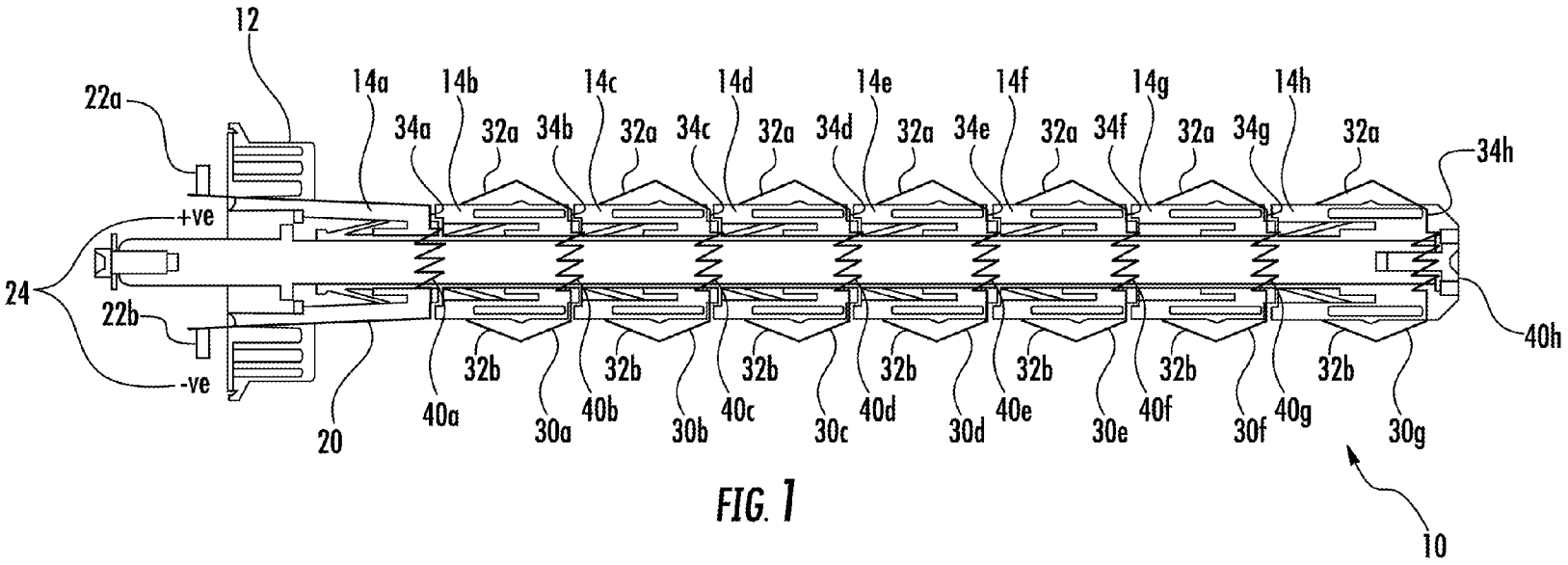
FIG. 1 schematically depicts a printer ribbon spindle assembly with the compressible clamps uncompressed in accordance with an exemplary embodiment of the present invention.

Referring now to FIG. 1, in an exemplary embodiment, the printer ribbon supply spindle assembly (10) is depicted with base (12) and multiple segments 14*a*-14*h*. The first segment (14*a*) is contiguous to the base (12). The subsequent segments (14*b*-14*h*) are contiguous to the previous segment. For example, segment (14*b*) is contiguous to segment (14*a*). Likewise, segment (14*c*) is contiguous to segment (14*d*), and so on. The segments may be, for example, one inch long. A two inch ribbon supply will cover 2 segments; a four inch ribbon supply will engage 4 segments. In the present embodiment, the printer ribbon supply spindle (10) has eight segments (14*a*-14*h*); however other numbers of segments are possible.

Figure 2:
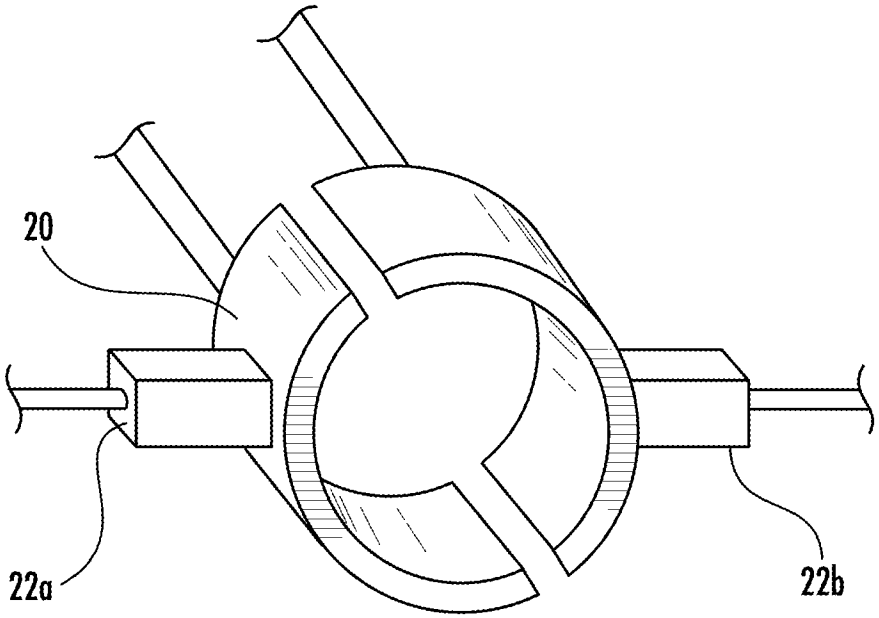
FIG. 2 schematically depicts the commutator and carbon brushes in accordance with an exemplary embodiment of the present invention.

In an exemplary embodiment schematically depicted in the present FIG. 1, the printer ribbon spindle assembly (10) is comprised of a commutator (20) disposed circumferentially on the first segment of the ribbon spindle (10) contiguous to the base (12). Two carbon brushes (22*a* and 22*b*) are provided and connected to a voltage source (designated generally as 24 in this Figure). The carbon brushes (22*a* and 22*b*) are disposed generally on either side of the commutator (20) and are in electrical contact with the commutator. The arrangement of the carbon brushes (22*a* and 22*b*) with the commutator (20) in isolation is illustrated in FIG. 2.

Referring back to FIG. 1, the voltage source (24), the carbon brushes (22*a* and 22*b*), and the commutator (20) form a closed electrical circuit.

The printer ribbon spindle assembly (10) is further comprised of a series of c-shaped conductive springs (30*a*-30*g*) disposed on each of the multiple segments. Each of the c-shaped conductive springs (30*a*-30*g*) has two ends (32*a* and 32*b*) and a center portion (34*a*-30*h*). The c-shaped conductive springs (30*a*-30*g*) remain in an uncompressed state (as shown) when no printer supply ribbon is loaded on the printer ribbon spindle assembly (10). Preferably, the c-shaped conductive springs (30*a*-30*g*) are metallic.

The c-shaped conductive spring (30*a*) over the second (14*b*) of the multiple segments has a length such that when the c-shaped conductive spring (30*a*) is compressed, the two ends (32*a* and 32*b*) of the c-shaped conductive spring (30*a*) will make electrical contact with the commutator (20), thus completing a first additional electrical circuit in parallel with the closed electrical circuit of the voltage source (24), the carbon brushes (22*a* and 22*b*), and the commutator (20).

The c-shaped conductive springs (30*b*-30*g*) over subsequent segments of the multiple segments (14*c*-14*h*), have lengths such that when the c-shaped conductive springs (30*b*-30*g*) are compressed, the two ends (32*a* and 32*b*) of each of the c-shaped conductive springs (30*b*-30*g*) make electrical contact with the c-shaped conductive spring of the previous segment, thus completing additional electrical circuits in parallel with the closed electrical circuit consisting of conductive spring (30*a*) and the voltage source (24), the carbon brushes (22*a* and 22*b*), and the commutator (20). This arrangement will be shown more clearly herein below in conjunction with FIG. 3.

The printer ribbon spindle assembly (10) is further comprised of basic electronic elements (40*b*-40*h*) disposed proximate to each of the center portions (34) of the c-shaped conductive springs (30*a*-30*g*) and in electrical contact with the center portions (34*a*-34*h*) of the c-shaped conductive springs (30*a*-30*g*). Additionally a basic electronic element (40*a*) may be provided at in the closed electrical circuit on the commutator.

In the present figure, the basic electronic elements (40*a*-4*h*) are resistors of known value. Thus the resistance of the closed electrical circuit will change depending on how many additional parallel electrical circuits are connected to the closed electrical circuit. When a resistance meter is placed in the electrical circuit, the change in resistance can be measured when a printer ribbon (not shown) is loaded on the printer ribbon supply spindle (10) indicating how many segments have been added to the circuit.

Figure 3:
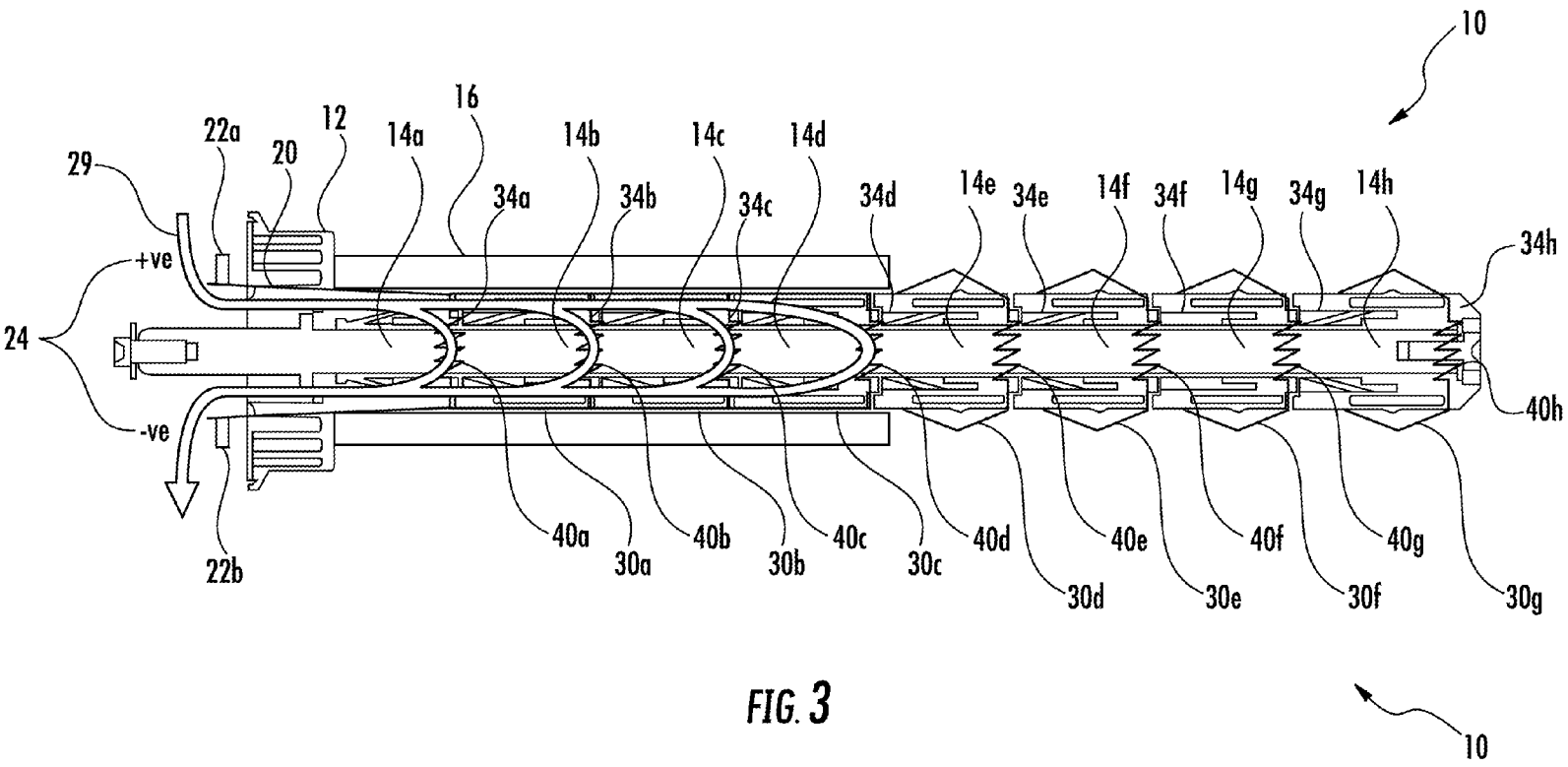
FIG. 3 schematically depicts the printer ribbon spindle assembly of FIG. 1 with the compressible clamps compressed, in accordance with an exemplary embodiment of the present invention.

Referring now to FIG. 3, the printer ribbon supply spindle (10) of FIG. 1 is shown with a printer ribbon (16) loaded on the printer ribbon supply spindle (10). In the Figure, the printer ribbon (16) covers and engages the commutator (20) and three segments (14*a*-14*d*), compressing c-shaped conductive springs (30*a*-30*c*). Thus three additional parallel electrical circuits are added to the closed electrical circuit consisting of the voltage source (24), the carbon brushes (22*a* and 22*b*), and the commutator (20). The c-shaped conductive springs (30*d*-30*g*) remain uncompressed. The path of electrical current (29) is shown passing through the connected electrical circuits.

Figure 4:
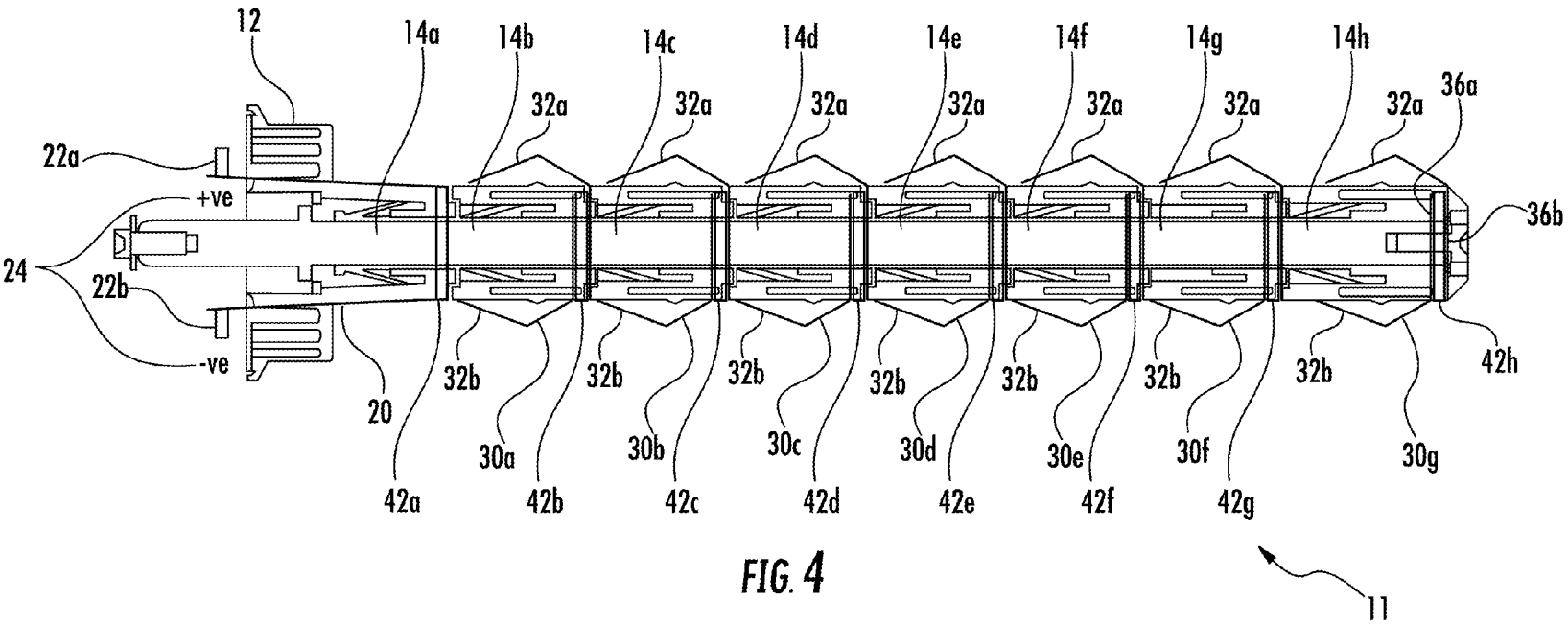
FIG. 4 schematically depicts a printer ribbon spindle assembly with the compressible clamps uncompressed in accordance with another exemplary embodiment of the present invention.

Referring now to FIG. 4, in another exemplary embodiment, the printer ribbon supply (11) is similar to that of FIGS. 1 and 3, except that the basic electronic element (42*a*-42*h*) is a dielectric material.

In the present embodiment, the center portions of the c-shaped conductive springs (30*a*-30*g*) are comprised of two conductive plates (36*a* and 36*b*). The dielectric material (42*a*-42*h*) lies between the two conductive plates (36*a* and 36*b*). The two conductive plates (36*a* and 36*b*) come in contact with the dielectric material (42*a*-42*h*) when the c-shaped conductive springs (30*a*-30*g*) are compressed.

Figure 5:
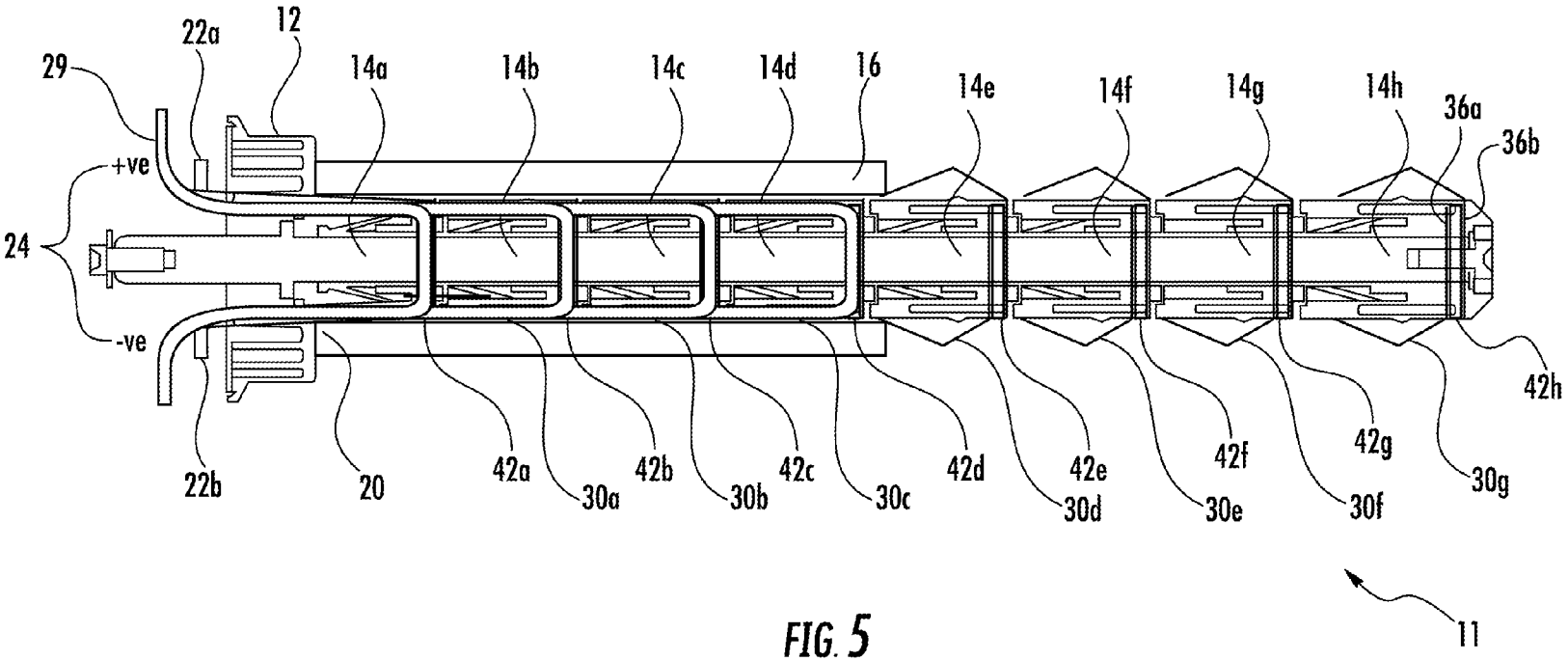
FIG. 5 schematically depicts the printer ribbon spindle assembly of FIG. 4 with the compressible clamps compressed, in accordance with an exemplary embodiment of the present invention.

Referring now to FIG. 5, the printer ribbon supply spindle (11) of FIG. 4 is shown with a printer ribbon (16) loaded on the printer ribbon supply spindle (11). In the Figure, the printer ribbon (16) covers and engages the commutator (20) and three segments (14*a*-14*d*), compressing c-shaped conductive springs (30*a*-30*c*). Thus three additional parallel electrical circuits are added to the closed electrical circuit consisting of the voltage source (24), the carbon brushes (22*a* and 22*b*), and the commutator (20). The c-shaped conductive springs (30*d*-30*g*) remain uncompressed. The path of electrical current (29) is shown passing through the connected electrical circuits. When a capacitance meter is placed in the electrical circuit, the change in capacitance can be measured when a printer ribbon (16) is loaded on the printer ribbon supply spindle (11) indicating how many segments have been added to the circuit.

Figure 6:
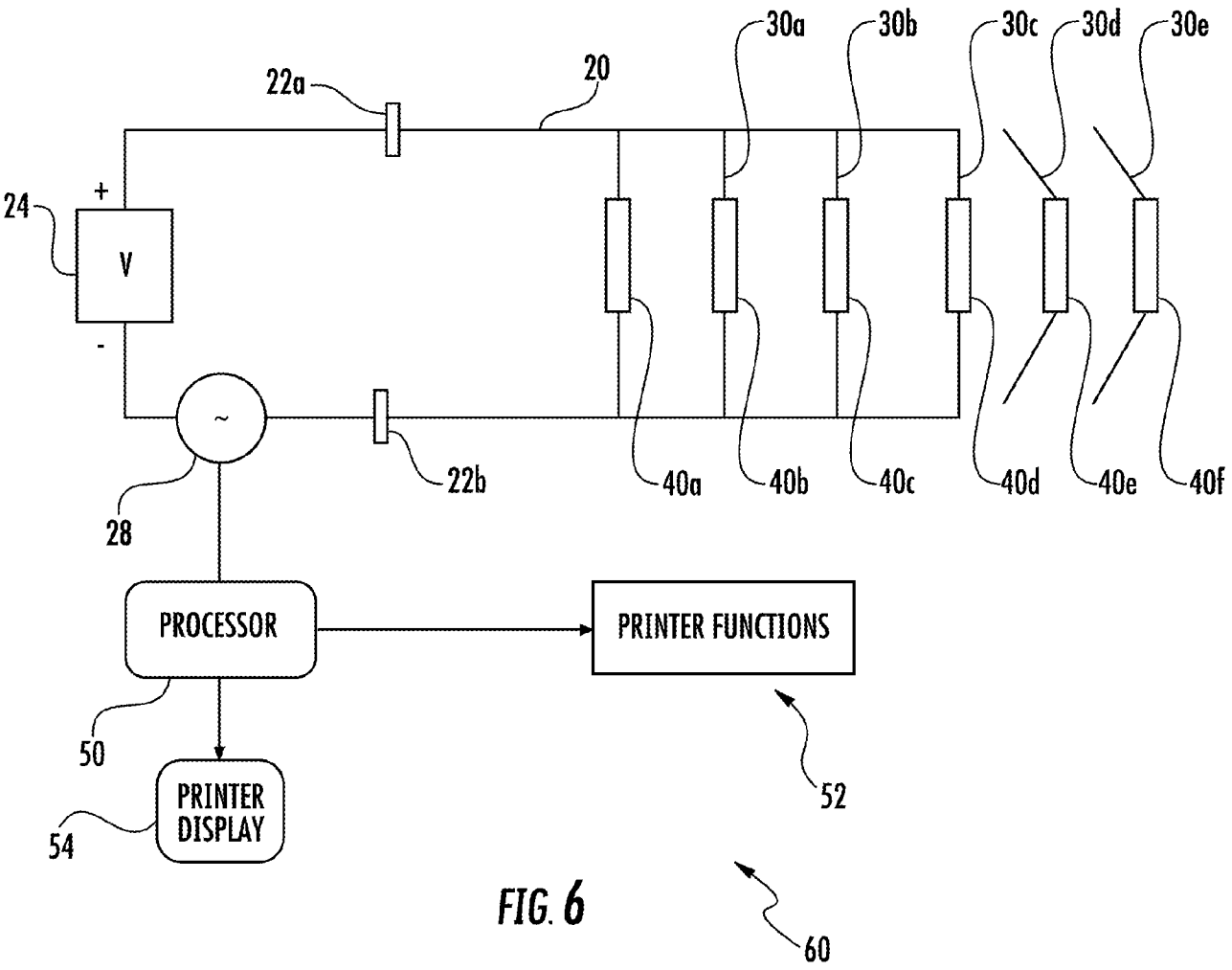
FIG. 6 schematically depicts an exemplary embodiment of a system for determining a width of a printer ribbon in accordance with the present invention.

In another exemplary embodiment, depicted in FIG. 6, a system (60) for determining the width of a ribbon roll mounted on a printer ribbon spindle is provided. The Figure is particularly directed to the electrical and the communicative links in the system (60) and thus some of the particular components, as illustrated in FIGS. 1-5 hereinbefore are not shown. For example, the printer ribbon supply spindle has a base and multiple segments. The first of the multiple segments are contiguous to the base. Each subsequent segment of the multiple segments is contiguous to the previous segment of the multiple segments. Thus the segments and the printer ribbon spindle assembly themselves are not shown. As in the exemplary embodiments described hereinbefore, the printer ribbon supply spindle comprises a commutator (20) disposed circumferentially on the first segment of the ribbon spindle. Also provided are two carbon brushes (22*a* and 22*b*). The carbon brushes (22*a* and 22*b*) are disposed generally on either side of the commutator (20) and are connected to a voltage source (24). The carbon brushes are in electrical contact with the commutator (20). Thus, the voltage source (24), the carbon brushes (22*a* and 22*b*), and the commutator (20) form a closed electrical circuit.

C-shaped conductive springs (30*a*-30*e*) are disposed over each of the multiple segments. The c-shaped conductive springs (30*a*-30*e*) each has two ends and a center portion as described hereinbefore. The c-shaped conductive springs (30*a*-30*e*) are in an uncompressed state when no printer ribbon is loaded over c-shaped conductive springs (30*a*-30*e*). When a printer ribbon is loaded over the c-shaped conductive springs c-shaped conductive springs (30*a*-30*e*), the c-shaped conductive springs c-shaped conductive springs (30*a*-30*e*) compress.

The c-shaped conductive spring (30*a*) over the second of the multiple segments has a length such that when the c-shaped conductive spring (30*a*) is in the compressed state, the two ends of the c-shaped conductive spring (30*a*) make electrical contact with the commutator (20) completing a first additional electrical circuit in parallel with the closed electrical circuit. In the present Figure, the c-shaped conductive spring (30*a*) is in a compressed state.

The c-shaped conductive springs (30*b*-30*e*) over subsequent segments of the multiple segments have lengths such that when the c-shaped conductive springs 30*b*-30*e*) are in the compressed state, the two ends of the c-shaped conductive springs make electrical contact with the c-shaped conductive spring of the previous segment, completing additional electrical circuits in parallel with the closed electrical circuit. In the present Figure, c-shaped constructive springs (30*b*-30*c*) are in a compressed state and conductive springs (30*d*-30*e*) are in an uncompressed state. This condition of the conductive springs (30*a*-30*c*) signifies that a printer ribbon that has a length of four segments is loaded on the printer ribbon spindle.

The system (60) further comprises a basic electronic element (40) disposed proximate to each of the center portions of the c-shaped conductive springs (30*a*-30*e*) and in electrical contact with the center portion of the c-shaped conductive springs (30*a*-30*e*). The basic electronic elements (40) are included in the additional electrical circuits in parallel with the closed electrical circuit when the c-shaped conductive springs (30*a*-30*e*) are compressed.

The system (60) further comprises a meter (28) in the closed electrical circuit. The meter (28) is sensitive to the electrical properties of the basic electronic element (40) such that the reading on the meter (28) indicates how many additional parallel circuits are completed.

The system further comprises a processor (50) communicatively linked to the meter (28). The processor is configured to determine the width of the ribbon roll loaded on the printer ribbon supply spindle based upon the reading on the meter (28). The processor is further configured to implement printer functions (52) based upon the reading on the meter (28). The printer functions (52) include torque requirements of the printer.

In a further exemplary embodiment, depicted in FIG. 6, the processor (50) is configured to send information on the width of the ribbon roll loaded on the printer ribbon supply spindle to a display (534) on the printer.

The basic electronic elements (40) may be resistors or dielectric material. If the basic electronic element (40) is a resister, then the meter (28) is an ohm-meter and reads the resistance of the completed circuits. If the basic electronic elements (40) are of a dielectric material, then the meter (28) reads capacitance changes in the circuits completed.

Figure 7:
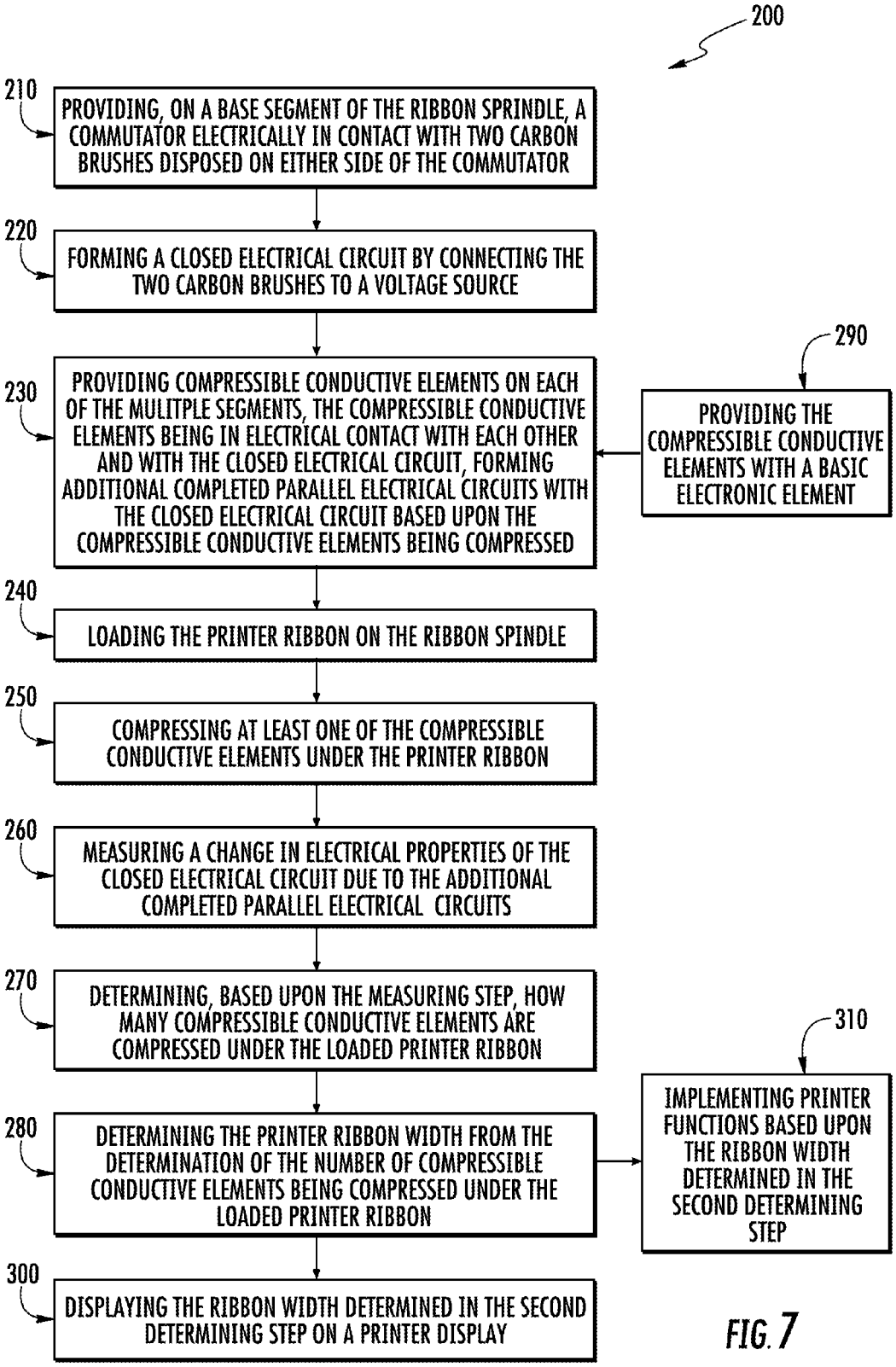
FIG. 7 depicts in a flowchart an exemplary embodiment of the method of determining a width of a printer ribbon in accordance with the present invention.

Referring now to FIG. 7, the present invention embraces a method (200) for determining a width of a printer ribbon loaded on a ribbon spindle having multiple segments. The method (200) is comprised of the steps of: (210) providing, on a base segment of the ribbon spindle, a commutator electrically in contact with two carbon brushes disposed on either side of the commutator; (220) forming a closed electrical circuit by connecting the two carbon brushes to a voltage source; (230) providing compressible conductive elements on each of the multiple segments, the compressible conductive elements being in electrical contact with each other and with the closed electrical circuit, thus forming additional completed parallel electrical circuits with the closed electrical circuit based upon the compressible conductive elements being compressed; (240) loading the printer ribbon on the ribbon spindle; (250) compressing at least one of the compressible conductive elements under the printer ribbon; (260) measuring a change in electrical properties of the closed electrical circuit due to the additional completed parallel electrical circuits; (270) determining, based upon the measuring step, how many compressible conductive elements are compressed under the loaded printer ribbon; and (280) determining the printer ribbon width from the determination of the number of compressible conductive elements being compressed under the loaded printer ribbon.

The method hereinabove described is particularly suitable to be used in conjunction with the system shown in FIG. 6.

In an exemplary embodiment, the method (200) may further comprised the step of (290) providing the compressible conductive elements with a basic electronic element. The change in electrical properties measured in the (260) measuring step are due to the basic electronic elements included in the completed additional parallel circuits formed by the (250) compressing step. In an exemplary embodiment, the basic electronic element is a resistor. The (260) measuring step measures a change in resistance.

In another exemplary embodiment, the basic electronic element is a dielectric material. The (260) measuring step measures a change in capacitance.

In another exemplary embodiment, the method (200) further includes the step of (300) displaying the ribbon width determined in the second (280) determining step on a printer display.

In another exemplary embodiment, the method (200) further includes the step of (310) implementing printer functions based upon the ribbon width determined in the second (280) determining step. The (310) implementing step is accomplished with a processor. The printer functions include torque requirements for the printer ribbon.

In the method (200) the (260) measuring step is accomplished with an electrical meter sensitive to the electrical properties of the basic electronic element.

Figure 8:
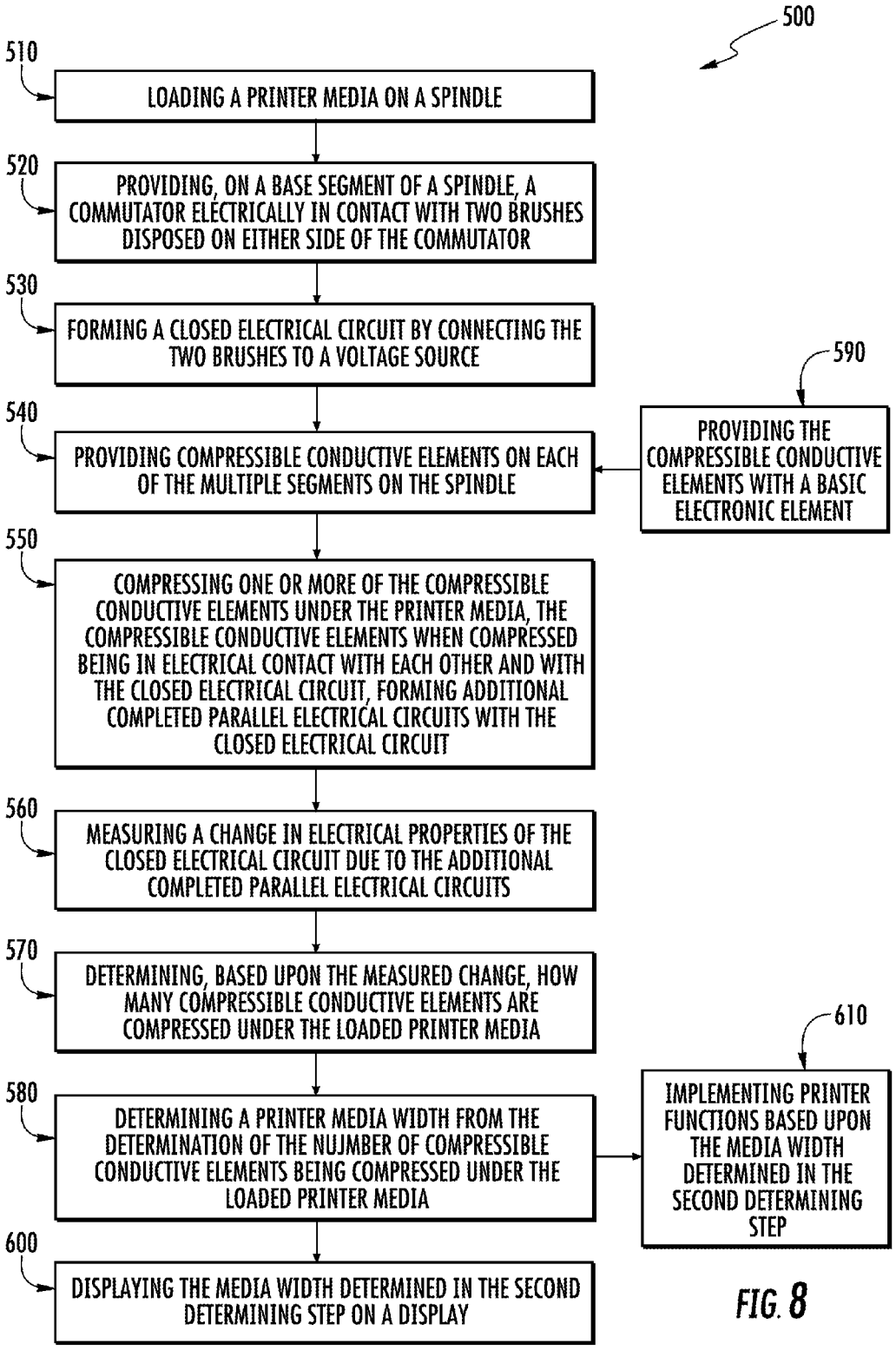
FIG. 8 depicts in a flowchart an exemplary embodiment of the method of determining a width of a printer media in accordance with the present invention.

Referring now to FIG. 8, the present invention embraces a method (500) for determining a width of a printer media loaded on a spindle having multiple segments. The method (500) is comprised of the steps of: (510) loading a printer media on a spindle; (520) providing, on a base segment of a spindle, a commutator electrically in contact with two brushes disposed on either side of the commutator; (530) forming a closed electrical circuit by connecting the two brushes to a voltage source; (540) providing compressible conductive elements on each of the multiple segments on the spindle; (550) compressing one or more of the compressible conductive elements under the printer media; (560) measuring a change in electrical properties of the closed electrical circuit due to the additional completed parallel electrical circuits; (570) determining, based upon the measured change, how many compressible conductive elements are compressed under the loaded printer media; and (580) determining a printer media width from the determination of the number of compressible conductive elements being compressed under the loaded printer media. Referring to step (550), the compressible conductive elements, when compressed, are in electrical contact with each other and with the closed electrical circuit. Thus the compressed conductive elements form additional completed parallel electrical circuits with the closed electrical circuit.

The media loaded on the printer spindle may be a conventional printer ribbon, labels, receipts, a thermal transfer ribbon, and the like.

The method (500) preferably also includes the step (590) of providing the compressible conductive elements with a basic electronic element. The change in electrical properties measured in the measuring step (560) is due to the basic electronic elements included in the completed additional parallel circuits formed by the compressing step (550).

The basic electronic element may be a resistor. The measuring step (560) measures a change in resistance when the basic electronic element is a resister.

Alternatively, the basic electronic element may be a dielectric material. In the present case, the measuring step (560) measures a change in capacitance.

The method (500) may also include the step of (600) displaying the media width determined in the second determining step (580) on a display. The display may be on the printer or on a display communicatively linked to the printer.

The method (500) may also include a step (610) of implementing printer functions based upon the media width determined in the second determining step (580). The printer functions may advantageously include torque requirements. For example, the printer may be provided with a processor to accomplish the second determining step (580), the displaying step (600), and the implementing step (610).

The measuring step (560) may be advantageously accomplished with an electrical meter sensitive to the electrical properties of the basic electronic element. That is, a resistance meter or capacitance meter, depending on the basic electronic element.

The method (500) hereinabove described and depicted in FIG. 8 is particularly suitable to be used in conjunction with the system shown in FIG. 6 and the printer spindle assembly shown in FIGS. 1-5.

To supplement the present disclosure, this application incorporates entirely by reference the following commonly assigned patents, patent application publications, and patent applications:

U.S. Pat. No. 6,832,725; U.S. Pat. No. 7,128,266; U.S. Pat. No. 7,159,783; U.S. Pat. No. 7,413,127; U.S. Pat. No. 7,726,575; U.S. Pat. No. 8,294,969; U.S. Pat. No. 8,317,105; U.S. Pat. No. 8,322,622; U.S. Pat. No. 8,366,005; U.S. Pat. No. 8,371,507; U.S. Pat. No. 8,376,233; U.S. Pat. No. 8,381,979; U.S. Pat. No. 8,390,909; U.S. Pat. No. 8,408,464; U.S. Pat. No. 8,408,468; U.S. Pat. No. 8,408,469; U.S. Pat. No. 8,424,768; U.S. Pat. No. 8,448,863; U.S. Pat. No. 8,457,013; U.S. Pat. No. 8,459,557; U.S. Pat. No. 8,469,272; U.S. Pat. No. 8,474,712; U.S. Pat. No. 8,479,992; U.S. Pat. No. 8,490,877; U.S. Pat. No. 8,517,271; U.S. Pat. No. 8,523,076; U.S. Pat. No. 8,528,818; U.S. Pat. No. 8,544,737; U.S. Pat. No. 8,548,242; U.S. Pat. No. 8,548,420; U.S. Pat. No. 8,550,335; U.S. Pat. No. 8,550,354; U.S. Pat. No. 8,550,357; U.S. Pat. No. 8,556,174; U.S. Pat. No. 8,556,176; U.S. Pat. No. 8,556,177; U.S. Pat. No. 8,559,767; U.S. Pat. No. 8,599,957; U.S. Pat. No. 8,561,895; U.S. Pat. No. 8,561,903; U.S. Pat. No. 8,561,905; U.S. Pat. No. 8,565,107; U.S. Pat. No. 8,571,307; U.S. Pat. No. 8,579,200; U.S. Pat. No. 8,583,924; U.S. Pat. No. 8,584,945; U.S. Pat. No. 8,587,595; U.S. Pat. No. 8,587,697; U.S. Pat. No. 8,588,869; U.S. Pat. No. 8,590,789; U.S. Pat. No. 8,596,539; U.S. Pat. No. 8,596,542; U.S. Pat. No. 8,596,543; U.S. Pat. No. 8,599,271; U.S. Pat. No. 8,599,957; U.S. Pat. No. 8,600,158; U.S. Pat. No. 8,600,167; U.S. Pat. No. 8,602,309; U.S. Pat. No. 8,608,053; U.S. Pat. No. 8,608,071; U.S. Pat. No. 8,611,309; U.S. Pat. No. 8,615,487; U.S. Pat. No. 8,616,454; U.S. Pat. No. 8,621,123; U.S. Pat. No. 8,622,303; U.S. Pat. No. 8,628,013; U.S. Pat. No. 8,628,015; U.S. Pat. No. 8,628,016; U.S. Pat. No. 8,629,926; U.S. Pat. No. 8,630,491; U.S. Pat. No. 8,635,309; U.S. Pat. No. 8,636,200; U.S. Pat. No. 8,636,212; U.S. Pat. No. 8,636,215; U.S. Pat. No. 8,636,224; U.S. Pat. No. 8,638,806; U.S. Pat. No. 8,640,958; U.S. Pat. No. 8,640,960; U.S. Pat. No. 8,643,717; U.S. Pat. No. 8,646,692; U.S. Pat. No. 8,646,694; U.S. Pat. No. 8,657,200; U.S. Pat. No. 8,659,397; U.S. Pat. No. 8,668,149; U.S. Pat. No. 8,678,285; U.S. Pat. No. 8,678,286; U.S. Pat. No. 8,682,077; U.S. Pat. No. 8,687,282; U.S. Pat. No. 8,692,927; U.S. Pat. No. 8,695,880; U.S. Pat. No. 8,698,949; U.S. Pat. No. 8,717,494; U.S. Pat. No. 8,717,494; U.S. Pat. No. 8,720,783; U.S. Pat. No. 8,723,804; U.S. Pat. No. 8,723,904; U.S. Pat. No. 8,727,223; U.S. Pat. No. D702,237; U.S. Pat. No. 8,740,082; U.S. Pat. No. 8,740,085; U.S. Pat. No. 8,746,563; U.S. Pat. No. 8,750,445; U.S. Pat. No. 8,752,766; U.S. Pat. No. 8,756,059; U.S. Pat. No. 8,757,495; U.S. Pat. No. 8,760,563; U.S. Pat. No. 8,763,909; U.S. Pat. No. 8,777,108; U.S. Pat. No. 8,777,109; U.S. Pat. No. 8,779,898; U.S. Pat. No. 8,781,520; U.S. Pat. No. 8,783,573; U.S. Pat. No. 8,789,757; U.S. Pat. No. 8,789,758; U.S. Pat. No. 8,789,759; U.S. Pat. No. 8,794,520; U.S. Pat. No. 8,794,522; U.S. Pat. No. 8,794,525; U.S. Pat. No. 8,794,526; U.S. Pat. No. 8,798,367; U.S. Pat. No. 8,807,431; U.S. Pat. No. 8,807,432; U.S. Pat. No. 8,820,630; U.S. Pat. No. 8,822,848; U.S. Pat. No. 8,824,692; U.S. Pat. No. 8,824,696; U.S. Pat. No. 8,842,849; U.S. Pat. No. 8,844,822; U.S. Pat. No. 8,844,823; U.S. Pat. No. 8,849,019; U.S. Pat. No. 8,851,383; U.S. Pat. No. 8,854,633; U.S. Pat. No. 8,866,963; U.S. Pat. No. 8,868,421; U.S. Pat. No. 8,868,519; U.S. Pat. No. 8,868,802; U.S. Pat. No. 8,868,803; U.S. Pat. No. 8,870,074; U.S. Pat. No. 8,879,639; U.S. Pat. No. 8,880,426; U.S. Pat. No. 8,881,983; U.S. Pat. No. 8,881,987; U.S. Pat. No. 8,903,172; U.S. Pat. No. 8,908,995; U.S. Pat. No. 8,910,870; U.S. Pat. No. 8,910,875; U.S. Pat. No. 8,914,290; U.S. Pat. No. 8,914,788; U.S. Pat. No. 8,915,439; U.S. Pat. No. 8,915,444; U.S. Pat. No. 8,916,789; U.S. Pat. No. 8,918,250; U.S. Pat. No. 8,918,564; U.S. Pat. No. 8,925,818; U.S. Pat. No. 8,939,374; U.S. Pat. No. 8,942,480; U.S. Pat. No. 8,944,313; U.S. Pat. No. 8,944,327; U.S. Pat. No. 8,944,332; U.S. Pat. No. 8,950,678; U.S. Pat. No. 8,967,468; U.S. Pat. No. 8,971,346; U.S. Pat. No. 8,976,030; U.S. Pat. No. 8,976,368; U.S. Pat. No. 8,978,981; U.S. Pat. No. 8,978,983; U.S. Pat. No. 8,978,984; U.S. Pat. No. 8,985,456; U.S. Pat. No. 8,985,457; U.S. Pat. No. 8,985,459; U.S. Pat. No. 8,985,461; U.S. Pat. No. 8,988,578; U.S. Pat. No. 8,988,590; U.S. Pat. No. 8,991,704; U.S. Pat. No. 8,996,194; U.S. Pat. No. 8,996,384; U.S. Pat. No. 9,002,641; U.S. Pat. No. 9,007,368; U.S. Pat. No. 9,010,641; U.S. Pat. No. 9,015,513; U.S. Pat. No. 9,016,576; U.S. Pat. No. 9,022,288; U.S. Pat. No. 9,030,964; U.S. Pat. No. 9,033,240;

U.S. Pat. No. 9,033,242; U.S. Pat. No. 9,036,054;
U.S. Pat. No. 9,037,344; U.S. Pat. No. 9,038,911;
U.S. Pat. No. 9,038,915; U.S. Pat. No. 9,047,098;
U.S. Pat. No. 9,047,359; U.S. Pat. No. 9,047,420;
U.S. Pat. No. 9,047,525; U.S. Pat. No. 9,047,531;
U.S. Pat. No. 9,053,055; U.S. Pat. No. 9,053,378;
U.S. Pat. No. 9,053,380; U.S. Pat. No. 9,058,526;
U.S. Pat. No. 9,064,165; U.S. Pat. No. 9,064,167;
U.S. Pat. No. 9,064,168; U.S. Pat. No. 9,064,254;
U.S. Pat. No. 9,066,032; U.S. Pat. No. 9,070,032;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D733,112;
U.S. Design Pat. No. D734,339;
International Publication No. 2013/163789;
International Publication No. 2013/173985;
International Publication No. 2014/019130;
International Publication No. 2014/110495;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0287258;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0313325;
U.S. Patent Application Publication No. 2013/0342717;
U.S. Patent Application Publication No. 2014/0001267;
U.S. Patent Application Publication No. 2014/0008439;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0042814;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0078341;
U.S. Patent Application Publication No. 2014/0078345;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0104451;
U.S. Patent Application Publication No. 2014/0106594;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0114530;
U.S. Patent Application Publication No. 2014/0124577;
U.S. Patent Application Publication No. 2014/0124579;
U.S. Patent Application Publication No. 2014/0125842;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131438;
U.S. Patent Application Publication No. 2014/0131441;
U.S. Patent Application Publication No. 2014/0131443;
U.S. Patent Application Publication No. 2014/0131444;
U.S. Patent Application Publication No. 2014/0131445;
U.S. Patent Application Publication No. 2014/0131448;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0151453;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166755;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0175172;
U.S. Patent Application Publication No. 2014/0191644;
U.S. Patent Application Publication No. 2014/0191913;
U.S. Patent Application Publication No. 2014/0197238;
U.S. Patent Application Publication No. 2014/0197239;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0217180;
U.S. Patent Application Publication No. 2014/0231500;
U.S. Patent Application Publication No. 2014/0232930;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0267609;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0278391;
U.S. Patent Application Publication No. 2014/0282210;
U.S. Patent Application Publication No. 2014/0284384;
U.S. Patent Application Publication No. 2014/0288933;

U.S. Patent Application Publication No. 2014/0297058;
U.S. Patent Application Publication No. 2014/0299665;
U.S. Patent Application Publication No. 2014/0312121;
U.S. Patent Application Publication No. 2014/0319220;
U.S. Patent Application Publication No. 2014/0319221;
U.S. Patent Application Publication No. 2014/0326787;
U.S. Patent Application Publication No. 2014/0332590;
U.S. Patent Application Publication No. 2014/0344943;
U.S. Patent Application Publication No. 2014/0346233;
U.S. Patent Application Publication No. 2014/0351317;
U.S. Patent Application Publication No. 2014/0353373;
U.S. Patent Application Publication No. 2014/0361073;
U.S. Patent Application Publication No. 2014/0361082;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0003673;
U.S. Patent Application Publication No. 2015/0009338;
U.S. Patent Application Publication No. 2015/0009610;
U.S. Patent Application Publication No. 2015/0014416;
U.S. Patent Application Publication No. 2015/0021397;
U.S. Patent Application Publication No. 2015/0028102;
U.S. Patent Application Publication No. 2015/0028103;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0048168;
U.S. Patent Application Publication No. 2015/0049347;
U.S. Patent Application Publication No. 2015/0051992;
U.S. Patent Application Publication No. 2015/0053766;
U.S. Patent Application Publication No. 2015/0053768;
U.S. Patent Application Publication No. 2015/0053769;
U.S. Patent Application Publication No. 2015/0060544;
U.S. Patent Application Publication No. 2015/0062366;
U.S. Patent Application Publication No. 2015/0063215;
U.S. Patent Application Publication No. 2015/0063676;
U.S. Patent Application Publication No. 2015/0069130;
U.S. Patent Application Publication No. 2015/0071819;
U.S. Patent Application Publication No. 2015/0083800;
U.S. Patent Application Publication No. 2015/0086114;
U.S. Patent Application Publication No. 2015/0088522;
U.S. Patent Application Publication No. 2015/0096872;
U.S. Patent Application Publication No. 2015/0099557;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0129659;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0136854;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0144701;
U.S. Patent Application Publication No. 2015/0149946;
U.S. Patent Application Publication No. 2015/0161429;
U.S. Patent Application Publication No. 2015/0169925;
U.S. Patent Application Publication No. 2015/0169929;
U.S. Patent Application Publication No. 2015/0178523;
U.S. Patent Application Publication No. 2015/0178534;
U.S. Patent Application Publication No. 2015/0178535;
U.S. Patent Application Publication No. 2015/0178536;
U.S. Patent Application Publication No. 2015/0178537;
U.S. Patent Application Publication No. 2015/0181093;
U.S. Patent Application Publication No. 2015/0181109;

U.S. patent application Ser. No. 13/367,978 for a Laser Scanning Module Employing an Elastomeric U-Hinge Based Laser Scanning Assembly, filed Feb. 7, 2012 (Feng et al.);

U.S. patent application Ser. No. 29/458,405 for an Electronic Device, filed Jun. 19, 2013 (Fitch et al.);

U.S. patent application Ser. No. 29/459,620 for an Electronic Device Enclosure, filed Jul. 2, 2013 (London et al.);

U.S. patent application Ser. No. 29/468,118 for an Electronic Device Case, filed Sep. 26, 2013 (Oberpriller et al.);

U.S. patent application Ser. No. 14/150,393 for Indicia-reader Having Unitary Construction Scanner, filed Jan. 8, 2014 (Colavito et al.);

U.S. patent application Ser. No. 14/200,405 for Indicia Reader for Size-Limited Applications filed Mar. 7, 2014 (Feng et al.);

U.S. patent application Ser. No. 14/231,898 for Hand-Mounted Indicia-Reading Device with Finger Motion Triggering filed Apr. 1, 2014 (Van Horn et al.);

U.S. patent application Ser. No. 29/486,759 for an Imaging Terminal, filed Apr. 2, 2014 (Oberpriller et al.);

U.S. patent application Ser. No. 14/257,364 for Docking System and Method Using Near Field Communication filed Apr. 21, 2014 (Showering);

U.S. patent application Ser. No. 14/264,173 for Autofocus Lens System for Indicia Readers filed Apr. 29, 2014 (Ackley et al.);

U.S. patent application Ser. No. 14/277,337 for MULTI-PURPOSE OPTICAL READER, filed May 14, 2014 (Jovanovski et al.);

U.S. patent application Ser. No. 14/283,282 for TERMINAL HAVING ILLUMINATION AND FOCUS CONTROL filed May 21, 2014 (Liu et al.);

U.S. patent application Ser. No. 14/327,827 for a MOBILE-PHONE ADAPTER FOR ELECTRONIC TRANSACTIONS, filed Jul. 10, 2014 (Hejl);

U.S. patent application Ser. No. 14/334,934 for a SYSTEM AND METHOD FOR INDICIA VERIFICATION, filed Jul. 18, 2014 (Hejl);

U.S. patent application Ser. No. 14/339,708 for LASER SCANNING CODE SYMBOL READING SYSTEM, filed Jul. 24, 2014 (Xian et al.);

U.S. patent application Ser. No. 14/340,627 for an AXIALLY REINFORCED FLEXIBLE SCAN ELEMENT, filed Jul. 25, 2014 (Rueblinger et al.);

U.S. patent application Ser. No. 14/446,391 for MULTI-FUNCTION POINT OF SALE APPARATUS WITH OPTICAL SIGNATURE CAPTURE filed Jul. 30, 2014 (Good et al.);

U.S. patent application Ser. No. 14/452,697 for INTERACTIVE INDICIA READER, filed Aug. 6, 2014 (Todeschini);

U.S. patent application Ser. No. 14/453,019 for DIMENSIONING SYSTEM WITH GUIDED ALIGNMENT, filed Aug. 6, 2014 (Li et al.);

U.S. patent application Ser. No. 14/462,801 for MOBILE COMPUTING DEVICE WITH DATA COGNITION SOFTWARE, filed on Aug. 19, 2014 (Todeschini et al.);

U.S. patent application Ser. No. 14/483,056 for VARIABLE DEPTH OF FIELD BARCODE SCANNER filed Sep. 10, 2014 (McCloskey et al.);

U.S. patent application Ser. No. 14/513,808 for IDENTIFYING INVENTORY ITEMS IN A STORAGE FACILITY filed Oct. 14, 2014 (Singel et al.);

U.S. patent application Ser. No. 14/519,195 for HANDHELD DIMENSIONING SYSTEM WITH FEEDBACK filed Oct. 21, 2014 (Laffargue et al.);

U.S. patent application Ser. No. 14/519,179 for DIMENSIONING SYSTEM WITH MULTIPATH INTERFERENCE MITIGATION filed Oct. 21, 2014 (Thuries et al.);

U.S. patent application Ser. No. 14/519,211 for SYSTEM AND METHOD FOR DIMENSIONING filed Oct. 21, 2014 (Ackley et al.);

U.S. patent application Ser. No. 14/519,233 for HANDHELD DIMENSIONER WITH DATA-QUALITY INDICATION filed Oct. 21, 2014 (Laffargue et al.);

U.S. patent application Ser. No. 14/519,249 for HANDHELD DIMENSIONING SYSTEM WITH MEASUREMENT-CONFORMANCE FEEDBACK filed Oct. 21, 2014 (Ackley et al.);

U.S. patent application Ser. No. 14/527,191 for METHOD AND SYSTEM FOR RECOGNIZING SPEECH USING WILDCARDS IN AN EXPECTED RESPONSE filed Oct. 29, 2014 (Braho et al.);

U.S. patent application Ser. No. 14/529,563 for ADAPTABLE INTERFACE FOR A MOBILE COMPUTING DEVICE filed Oct. 31, 2014 (Schoon et al.);

U.S. patent application Ser. No. 14/529,857 for BARCODE READER WITH SECURITY FEATURES filed Oct. 31, 2014 (Todeschini et al.);

U.S. patent application Ser. No. 14/398,542 for PORTABLE ELECTRONIC DEVICES HAVING A SEPARATE LOCATION TRIGGER UNIT FOR USE IN CONTROLLING AN APPLICATION UNIT filed Nov. 3, 2014 (Bian et al.);

U.S. patent application Ser. No. 14/531,154 for DIRECTING AN INSPECTOR THROUGH AN INSPECTION filed Nov. 3, 2014 (Miller et al.);

U.S. patent application Ser. No. 14/533,319 for BARCODE SCANNING SYSTEM USING WEARABLE DEVICE WITH EMBEDDED CAMERA filed Nov. 5, 2014 (Todeschini);

U.S. patent application Ser. No. 14/535,764 for CONCATENATED EXPECTED RESPONSES FOR SPEECH RECOGNITION filed Nov. 7, 2014 (Braho et al.);

U.S. patent application Ser. No. 14/568,305 for AUTO-CONTRAST VIEWFINDER FOR AN INDICIA READER filed Dec. 12, 2014 (Todeschini);

U.S. patent application Ser. No. 14/573,022 for DYNAMIC DIAGNOSTIC INDICATOR GENERATION filed Dec. 17, 2014 (Goldsmith);

U.S. patent application Ser. No. 14/578,627 for SAFETY SYSTEM AND METHOD filed Dec. 22, 2014 (Ackley et al.);

U.S. patent application Ser. No. 14/580,262 for MEDIA GATE FOR THERMAL TRANSFER PRINTERS filed Dec. 23, 2014 (Bowles);

U.S. patent application Ser. No. 14/590,024 for SHELVING AND PACKAGE LOCATING SYSTEMS FOR DELIVERY VEHICLES filed Jan. 6, 2015 (Payne);

U.S. patent application Ser. No. 14/596,757 for SYSTEM AND METHOD FOR DETECTING BARCODE PRINTING ERRORS filed Jan. 14, 2015 (Ackley);

U.S. patent application Ser. No. 14/416,147 for OPTICAL READING APPARATUS HAVING VARIABLE SETTINGS filed Jan. 21, 2015 (Chen et al.);

U.S. patent application Ser. No. 14/614,706 for DEVICE FOR SUPPORTING AN ELECTRONIC TOOL ON A USER'S HAND filed Feb. 5, 2015 (Oberpriller et al.);

U.S. patent application Ser. No. 14/614,796 for CARGO APPORTIONMENT TECHNIQUES filed Feb. 5, 2015 (Morton et al.);

U.S. patent application Ser. No. 29/516,892 for TABLE COMPUTER filed Feb. 6, 2015 (Bidwell et al.);

U.S. patent application Ser. No. 14/619,093 for METHODS FOR TRAINING A SPEECH RECOGNITION SYSTEM filed Feb. 11, 2015 (Pecorari);

U.S. patent application Ser. No. 14/628,708 for DEVICE, SYSTEM, AND METHOD FOR DETERMINING THE STATUS OF CHECKOUT LANES filed Feb. 23, 2015 (Todeschini);

U.S. patent application Ser. No. 14/630,841 for TERMINAL INCLUDING IMAGING ASSEMBLY filed Feb. 25, 2015 (Gomez et al.);

U.S. patent application Ser. No. 14/635,346 for SYSTEM AND METHOD FOR RELIABLE STORE-AND-FORWARD DATA HANDLING BY ENCODED INFORMATION READING TERMINALS filed Mar. 2, 2015 (Sevier);

U.S. patent application Ser. No. 29/519,017 for SCANNER filed Mar. 2, 2015 (Zhou et al.);

U.S. patent application Ser. No. 14/405,278 for DESIGN PATTERN FOR SECURE STORE filed Mar. 9, 2015 (Zhu et al.);

U.S. patent application Ser. No. 14/660,970 for DECODABLE INDICIA READING TERMINAL WITH COMBINED ILLUMINATION filed Mar. 18, 2015 (Kearney et al.);

U.S. patent application Ser. No. 14/661,013 for REPROGRAMMING SYSTEM AND METHOD FOR DEVICES INCLUDING PROGRAMMING SYMBOL filed Mar. 18, 2015 (Soule et al.);

U.S. patent application Ser. No. 14/662,922 for MULTI-FUNCTION POINT OF SALE SYSTEM filed Mar. 19, 2015 (Van Horn et al.);

U.S. patent application Ser. No. 14/663,638 for VEHICLE MOUNT COMPUTER WITH CONFIGURABLE IGNITION SWITCH BEHAVIOR filed Mar. 20, 2015 (Davis et al.);

U.S. patent application Ser. No. 14/664,063 for METHOD AND APPLICATION FOR SCANNING A BARCODE WITH A SMART DEVICE WHILE CONTINUOUSLY RUNNING AND DISPLAYING AN APPLICATION ON THE SMART DEVICE DISPLAY filed Mar. 20, 2015 (Todeschini);

U.S. patent application Ser. No. 14/669,280 for TRANSFORMING COMPONENTS OF A WEB PAGE TO VOICE PROMPTS filed Mar. 26, 2015 (Funyak et al.);

U.S. patent application Ser. No. 14/674,329 for AIMER FOR BARCODE SCANNING filed Mar. 31, 2015 (Bidwell);

U.S. patent application Ser. No. 14/676,109 for INDICIA READER filed Apr. 1, 2015 (Huck);

U.S. patent application Ser. No. 14/676,327 for DEVICE MANAGEMENT PROXY FOR SECURE DEVICES filed Apr. 1, 2015 (Yeakley et al.);

U.S. patent application Ser. No. 14/676,898 for NAVIGATION SYSTEM CONFIGURED TO INTEGRATE MOTION SENSING DEVICE INPUTS filed Apr. 2, 2015 (Showering);

U.S. patent application Ser. No. 14/679,275 for DIMENSIONING SYSTEM CALIBRATION SYSTEMS AND METHODS filed Apr. 6, 2015 (Laffargue et al.);

U.S. patent application Ser. No. 29/523,098 for HANDLE FOR A TABLET COMPUTER filed Apr. 7, 2015 (Bidwell et al.);

U.S. patent application Ser. No. 14/682,615 for SYSTEM AND METHOD FOR POWER MANAGEMENT OF MOBILE DEVICES filed Apr. 9, 2015 (Murawski et al.);

U.S. patent application Ser. No. 14/686,822 for MULTIPLE PLATFORM SUPPORT SYSTEM AND METHOD filed Apr. 15, 2015 (Qu et al.);

U.S. patent application Ser. No. 14/687,289 for SYSTEM FOR COMMUNICATION VIA A PERIPHERAL HUB filed Apr. 15, 2015 (Kohtz et al.);

U.S. patent application Ser. No. 29/524,186 for SCANNER filed Apr. 17, 2015 (Zhou et al.);

U.S. patent application Ser. No. 14/695,364 for MEDICATION MANAGEMENT SYSTEM filed Apr. 24, 2015 (Sewell et al.);

U.S. patent application Ser. No. 14/695,923 for SECURE UNATTENDED NETWORK AUTHENTICATION filed Apr. 24, 2015 (Kubler et al.);

U.S. patent application Ser. No. 29/525,068 for TABLET COMPUTER WITH REMOVABLE SCANNING DEVICE filed Apr. 27, 2015 (Schulte et al.);

U.S. patent application Ser. No. 14/699,436 for SYMBOL READING SYSTEM HAVING PREDICTIVE DIAGNOSTICS filed Apr. 29, 2015 (Nahill et al.);

U.S. patent application Ser. No. 14/702,110 for SYSTEM AND METHOD FOR REGULATING BARCODE DATA INJECTION INTO A RUNNING APPLICATION ON A SMART DEVICE filed May 1, 2015 (Todeschini et al.);

U.S. patent application Ser. No. 14/702,979 for TRACKING BATTERY CONDITIONS filed May 4, 2015 (Young et al.);

U.S. patent application Ser. No. 14/704,050 for INTERMEDIATE LINEAR POSITIONING filed May 5, 2015 (Charpentier et al.);

U.S. patent application Ser. No. 14/705,012 for HANDS-FREE HUMAN MACHINE INTERFACE RESPONSIVE TO A DRIVER OF A VEHICLE filed May 6, 2015 (Fitch et al.);

U.S. patent application Ser. No. 14/705,407 for METHOD AND SYSTEM TO PROTECT SOFTWARE-BASED NETWORK-CONNECTED DEVICES FROM ADVANCED PERSISTENT THREAT filed May 6, 2015 (Hussey et al.);

U.S. patent application Ser. No. 14/707,037 for SYSTEM AND METHOD FOR DISPLAY OF INFORMATION USING A VEHICLE-MOUNT COMPUTER filed May 8, 2015 (Chamberlin);

U.S. patent application Ser. No. 14/707,123 for APPLICATION INDEPENDENT DEX/UCS INTERFACE filed May 8, 2015 (Pape);

U.S. patent application Ser. No. 14/707,492 for METHOD AND APPARATUS FOR READING OPTICAL INDICIA USING A PLURALITY OF DATA SOURCES filed May 8, 2015 (Smith et al.);

U.S. patent application Ser. No. 14/710,666 for PRE-PAID USAGE SYSTEM FOR ENCODED INFORMATION READING TERMINALS filed May 13, 2015 (Smith);

U.S. patent application Ser. No. 29/526,918 for CHARGING BASE filed May 14, 2015 (Fitch et al.);

U.S. patent application Ser. No. 14/715,672 for AUGUMENTED REALITY ENABLED HAZARD DISPLAY filed May 19, 2015 (Venkatesha et al.);

U.S. patent application Ser. No. 14/715,916 for EVALUATING IMAGE VALUES filed May 19, 2015 (Ackley);

U.S. patent application Ser. No. 14/722,608 for INTERACTIVE USER INTERFACE FOR CAPTURING A DOCUMENT IN AN IMAGE SIGNAL filed May 27, 2015 (Showering et al.);

U.S. patent application Ser. No. 29/528,165 for IN-COUNTER BARCODE SCANNER filed May 27, 2015 (Oberpriller et al.);

U.S. patent application Ser. No. 14/724,134 for ELECTRONIC DEVICE WITH WIRELESS PATH SELECTION CAPABILITY filed May 28, 2015 (Wang et al.);

U.S. patent application Ser. No. 14/724,849 for METHOD OF PROGRAMMING THE DEFAULT CABLE INTERFACE SOFTWARE IN AN INDICIA READING DEVICE filed May 29, 2015 (Barten);

U.S. patent application Ser. No. 14/724,908 for IMAGING APPARATUS HAVING IMAGING ASSEMBLY filed May 29, 2015 (Barber et al.);

U.S. patent application Ser. No. 14/725,352 for APPARATUS AND METHODS FOR MONITORING ONE OR MORE PORTABLE DATA TERMINALS (Caballero et al.);

U.S. patent application Ser. No. 29/528,590 for ELECTRONIC DEVICE filed May 29, 2015 (Fitch et al.);

U.S. patent application Ser. No. 29/528,890 for MOBILE COMPUTER HOUSING filed Jun. 2, 2015 (Fitch et al.);

U.S. patent application Ser. No. 14/728,397 for DEVICE MANAGEMENT USING VIRTUAL INTERFACES CROSS-REFERENCE TO RELATED APPLICATIONS filed Jun. 2, 2015 (Caballero);

U.S. patent application Ser. No. 14/732,870 for DATA COLLECTION MODULE AND SYSTEM filed Jun. 8, 2015 (Powilleit);

U.S. patent application Ser. No. 29/529,441 for INDICIA READING DEVICE filed Jun. 8, 2015 (Zhou et al.);

U.S. patent application Ser. No. 14/735,717 for INDICIA-READING SYSTEMS HAVING AN INTERFACE WITH A USER'S NERVOUS SYSTEM filed Jun. 10, 2015 (Todeschini);

U.S. patent application Ser. No. 14/738,038 for METHOD OF AND SYSTEM FOR DETECTING OBJECT WEIGHING INTERFERENCES filed Jun. 12, 2015 (Amundsen et al.);

U.S. patent application Ser. No. 14/740,320 for TACTILE SWITCH FOR A MOBILE ELECTRONIC DEVICE filed Jun. 16, 2015 (Bandringa);

U.S. patent application Ser. No. 14/740,373 for CALIBRATING A VOLUME DIMENSIONER filed Jun. 16, 2015 (Ackley et al.);

U.S. patent application Ser. No. 14/742,818 for INDICIA READING SYSTEM EMPLOYING DIGITAL GAIN CONTROL filed Jun. 18, 2015 (Xian et al.);

U.S. patent application Ser. No. 14/743,257 for WIRELESS MESH POINT PORTABLE DATA TERMINAL filed Jun. 18, 2015 (Wang et al.);

U.S. patent application Ser. No. 29/530,600 for CYCLONE filed Jun. 18, 2015 (Vargo et al);

U.S. patent application Ser. No. 14/744,633 for IMAGING APPARATUS COMPRISING IMAGE SENSOR ARRAY HAVING SHARED GLOBAL SHUTTER CIRCUITRY filed Jun. 19, 2015 (Wang);

U.S. patent application Ser. No. 14/744,836 for CLOUD-BASED SYSTEM FOR READING OF DECODABLE INDICIA filed Jun. 19, 2015 (Todeschini et al.);

U.S. patent application Ser. No. 14/745,006 for SELECTIVE OUTPUT OF DECODED MESSAGE DATA filed Jun. 19, 2015 (Todeschini et al.);

U.S. patent application Ser. No. 14/747,197 for OPTICAL PATTERN PROJECTOR filed Jun. 23, 2015 (Thuries et al.);

U.S. patent application Ser. No. 14/747,490 for DUAL-PROJECTOR THREE-DIMENSIONAL SCANNER filed Jun. 23, 2015 (Jovanovski et al.); and U.S. patent application Ser. No. 14/748,446 for CORDLESS INDICIA READER WITH A MULTIFUNCTION COIL FOR WIRELESS CHARGING AND EAS DEACTIVATION, filed Jun. 24, 2015 (Xie et al.).

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A printer spindle assembly, comprising:

multiple segments, the first segment of the multiple segments being adjacent to a base, each subsequent segment of the multiple segments being adjacent to the previous segment of the multiple segments;

a commutator, the commutator being disposed circumferentially on the first segment of the spindle;

at least two brushes, the brushes being connected to a voltage source, disposed generally on either side of the commutator, and in electrical contact with the commutator, wherein the voltage source, the brushes, and the commutator form a closed electrical circuit;

a c-shaped conductive spring disposed on each of the multiple segments;

wherein the c-shaped conductive spring has two ends and a center portion;

wherein the c-shaped conductive springs are in an uncompressed state in the absence of a printer ribbon over the one or more c-shaped conductive springs; and wherein the c-shaped conductive springs are in a compressed state in the presence of a printer ribbon positioned over the one or more c-shaped conductive springs.

2. The printer spindle assembly of claim 1, wherein the c-shaped conductive springs are metallic.

3. The printer spindle assembly of claim 1, wherein the c-shaped conductive spring on each segment of the multiple segments has a length such that when the c-shaped conductive spring is in the compressed state, the two ends of the c-shaped conductive spring make electrical contact with the commutator or the c-shaped conductive spring of a previous segment completing an additional electrical circuit in parallel with the closed electrical circuit.

4. The printer spindle assembly of claim 3 wherein a basic electronic element is disposed proximate to the center portions of each of the c-shaped conductive springs and in electrical contact with the center portion of the c-shaped conductive springs.

5. The printer spindle assembly of claim 4, wherein the basic electronic element is a resistor.

6. The printer spindle assembly of claim 4, wherein the basic electronic element is a dielectric material.

7. The printer spindle assembly of claim 6, wherein the center portion of the c-shaped conductive springs is comprised of two conductive plates and a dielectric material; the conductive plates being on either side of the dielectric material; the conductive plates coming in contact with the dielectric material based upon the c-shaped conductive springs being compressed.

8. The printer spindle assembly of claim 4, wherein each additional circuit includes the basic electronic element.

9. The printer spindle of claim 4, wherein the basic electronic element is a resistor; the printer spindle assembly further comprising a meter, the meter being connected to the closed electrical circuit; and wherein the meter reads the resistance of the completed circuits.

10. The printer spindle of claim 4, wherein the basic electronic element is a dielectric material; the printer spindle assembly further comprising a meter, the meter being connected to the closed electrical circuit; and wherein the meter reads capacitance changes in the circuits completed.

11. The printer spindle assembly of claim 3, further comprising a meter, the meter connected to the closed electrical circuit, such that the reading on the meter indicates how many additional parallel circuits are completed.

12. The printer spindle assembly of claim 11, further comprising a processor communicatively linked to the meter, the processor being configured to determine a width of a ribbon roll loaded on the printer spindle based upon a reading on the meter and to implement printer functions based upon the reading on the meter.

13. The printer spindle of claim 8, wherein the processor is further configured to send information on the width of the ribbon roll loaded on the spindle to a display.

14. The printer spindle of claim 8, wherein the printer functions include torque requirements of the printer.

15. A method, comprising:

loading a printer media on a spindle;

providing, on a base segment of a spindle, a commutator electrically in contact with two brushes disposed on either side of the commutator;

forming a closed electrical circuit by connecting the two brushes to a voltage source;

providing compressible conductive elements on each of multiple segments on the spindle;

compressing one or more of the compressible conductive elements under the printer media, the compressible conductive elements when compressed being in electrical contact with each other and with the closed electrical circuit, forming additional completed parallel electrical circuits with the closed electrical circuit;

measuring a change in electrical properties of the closed electrical circuit due to the additional completed parallel electrical circuits;

determining, based upon the measured change, how many compressible conductive elements are compressed under the loaded printer media; and determining a printer media width from the determination of the number of compressible conductive elements being compressed under the loaded printer media.

16. The method of claim 15, wherein the media is selected from a ribbon, a label, a receipt, and a thermal transfer ribbon.

17. The method of claim 16, wherein the measuring step is accomplished with an electrical meter sensitive to the electrical properties of the basic electronic element.

18. The method of claim 15, further comprising the step of providing the compressible conductive elements with a basic electronic element.

19. The method of claim 18, wherein the basic electronic element is a dielectric material; and the measuring step measures a change in capacitance.

20. The method of claim 18, wherein the change in electrical properties measured in the measuring step are due to the basic electronic elements included in the completed additional parallel circuits formed by the compressing step.

21. The method of claim 18, wherein the basic electronic element is a resistor.

22. The method of claim 21, wherein the measuring step measures a change in resistance.

23. The method of claim 15, further comprising the step of displaying the media width determined in the second determining step on a display.

24. The method of claim 15, further comprising the step of implementing printer functions based upon the media width determined in the second determining step.

25. The method of claim 24, wherein the printer functions include torque requirements.

* * * * *